US009816259B2

(12) United States Patent
Ahola et al.

(10) Patent No.: US 9,816,259 B2
(45) Date of Patent: Nov. 14, 2017

(54) WATER TANK SYSTEM FOR TOILET

(71) Applicant: Kohler Co., Kohler, WI (US)

(72) Inventors: Billy Jack Ahola, Manitowoc, WI (US); Andrew L. Smith, Sheboygan, WI (US); Lawrence Westphal, Plymouth, WI (US); Peter W. Swart, Oostburg, WI (US); Mark E. Baumgartner, Sheboygan, WI (US); Lawrence Duwell, Adell, WI (US); Don Bogenshuetz, Sheboygan, WI (US); Tobin J. Vetting, Sheboygan Falls, WI (US); John F. Emmerling, Howards Grove, WI (US)

(73) Assignee: KOHLER CO., Kohler, WI (US)

( * ) Notice: Subject to any disclaimer, the term of this patent is extended or adjusted under 35 U.S.C. 154(b) by 335 days.

(21) Appl. No.: 14/303,346

(22) Filed: Jun. 12, 2014

(65) Prior Publication Data

US 2014/0366259 A1 Dec. 18, 2014

Related U.S. Application Data

(60) Provisional application No. 61/835,404, filed on Jun. 14, 2013.

(51) Int. Cl.
*E03D 3/10* (2006.01)
*E03D 1/30* (2006.01)

(52) U.S. Cl.
CPC ..... *E03D 3/10* (2013.01); *E03D 1/30* ( 2013.01)

(58) Field of Classification Search
CPC ..... E03D 3/10; E03D 1/30
USPC ..... 4/357, 358, 359, 396
See application file for complete search history.

(56) References Cited

U.S. PATENT DOCUMENTS

| | | | | |
|---|---|---|---|---|
| 369,003 | A * | 8/1887 | Harvey | E03D 3/10 137/433 |
| 1,553,616 | A | 9/1925 | Johnson | |
| 2,714,723 | A * | 8/1955 | Griffon | E03D 3/10 4/357 |
| 3,041,629 | A * | 7/1962 | Pratt | E03D 1/38 4/357 |

(Continued)

FOREIGN PATENT DOCUMENTS

| | | |
|---|---|---|
| CN | 202787447 | 3/2014 |
| DE | 202007016733 U1 | 3/2008 |
| FR | 2480823 A1 | 10/1981 |

OTHER PUBLICATIONS

First Office Action regarding Chinese Application No. 201420316208.X.

(Continued)

*Primary Examiner* — Christine Skubinna
(74) *Attorney, Agent, or Firm* — Foley & Lardner LLP

(57) ABSTRACT

One embodiment of the present application relates to a water tank for a toilet. The water tank includes a first chamber comprising an orifice for connecting to a toilet bowl. The water tank further includes a free-floating member within the first chamber that is not coupled to any other component and that is configured to selectively engage with and disengage from the orifice to selectively block or allow a flow of water through the orifice. The free-floating member can be selectively disengaged from the orifice via an actuator or a differential pressure within the water tank.

13 Claims, 35 Drawing Sheets

(56) References Cited

U.S. PATENT DOCUMENTS

| | | | | |
|---|---|---|---|---|
| 3,324,481 | A * | 6/1967 | Emerson | E03D 5/09 4/357 |
| 3,668,709 | A * | 6/1972 | Sharp | E03D 3/10 4/357 |
| 2005/0150038 | A1 * | 7/2005 | Li | E03D 3/10 4/354 |

OTHER PUBLICATIONS

Notification of International Search Report and Written Opinion Application No. PCT/US2014/042173 dated Aug. 14, 2014, 32 pages.

* cited by examiner

WATER TANK SYSTEM FOR TOILET

CROSS-REFERENCE TO RELATED PATENT APPLICATIONS

This application claims priority to U.S. Provisional Patent Application No. 61/835,404, filed Jun. 14, 2013, the entire disclosure of which is incorporated by reference herein.

BACKGROUND

The present application relates generally to water tanks. More specifically, the present application relates to water tank systems for toilets and the like.

Toilets typically include water tanks for storing clean water. The water tank is fluidly connected to the toilet bowl and stores water until a flush cycle is initiated, at which point the water is passed from the tank to the toilet bowl.

Water tanks generally house or contain a number of mechanical components such as, for example, components of a flush mechanism (e.g., flush valves, chains or other mechanical linkages between a flush valve and a flush lever or control, etc.). These components may be subjected to numerous cycles per day, such as in the case of public restrooms, which may undergo hundreds or thousands of flush cycles in a given day. Over time, these mechanical components may wear out or fail, which may require such components to be serviced or replaced.

Toilet water tanks are also typically designed to work with a particular toilet design. For example, a toilet may be designed to have a particular aesthetic design. Because the size and shape of the tank will vary between different toilet designs, each new tank must be tested and validated to ensure that its performance is satisfactory for the intended application. For example, the water flow characteristics of the toilet tank must be analyzed to ensure that an appropriate amount of water is delivered to the associated toilet bowl during a flush cycle. Such testing may be relatively resource and time intensive, making the process of designing a new toilet less flexible than may be desired, since aesthetic and functional aspects of the toilet design must both be designed with the other in mind. Aesthetic changes in toilet designs may also necessitate an evaluation of the appropriate internal mechanical components that may be used within the toilet tank. For example, a smaller toilet tank may require the use of smaller or differently-configured flush mechanism components, thus requiring different flushing mechanisms to be used across different product lines.

It would be desirable to provide a toilet tank design that addresses one or more of the foregoing issues and/or that enhances the performance of a toilet of which it is a part.

SUMMARY

One embodiment of the present application relates to a water tank for a toilet. The water tank includes a first chamber comprising an orifice for connecting to a toilet bowl. The water tank further includes a free-floating member within the first chamber that is not coupled to any other component and that is configured to selectively engage with and disengage from the orifice to selectively block or allow a flow of water through the orifice.

Another embodiment of the present application relates to a water tank assembly for a toilet. The water tank assembly includes a water tank and a cover. The water tank includes a first chamber having an orifice for connecting to a toilet bowl. The water tank further includes a free-floating member within the tank that is configured for selective engagement with the orifice to block or allow a flow of water through the orifice. The cover is configured to fit over the water tank and couple to the toilet.

Yet another embodiment of the present application relates to a water tank for a toilet. The water tank includes a first chamber comprising an orifice for fluidly connecting the first chamber to a toilet bowl and further comprising a first check valve for fluidly connecting the first chamber to the outside atmosphere. The water tank further includes a second chamber fluidly connected to the first chamber and further comprising a second check valve for fluidly connecting the second chamber to the outside atmosphere. The water tank further includes a free-floating member in the first chamber selectively engaged with the orifice and configured to block a flow of water through the orifice. The first and second check valves are configured to selectively release a volume of air from the water tank, creating a differential pressure within the water tank such that the free-floating member is selectively disengaged from the orifice, allowing water to exit the water tank through the orifice.

DETAILED DESCRIPTION

Figure 1:
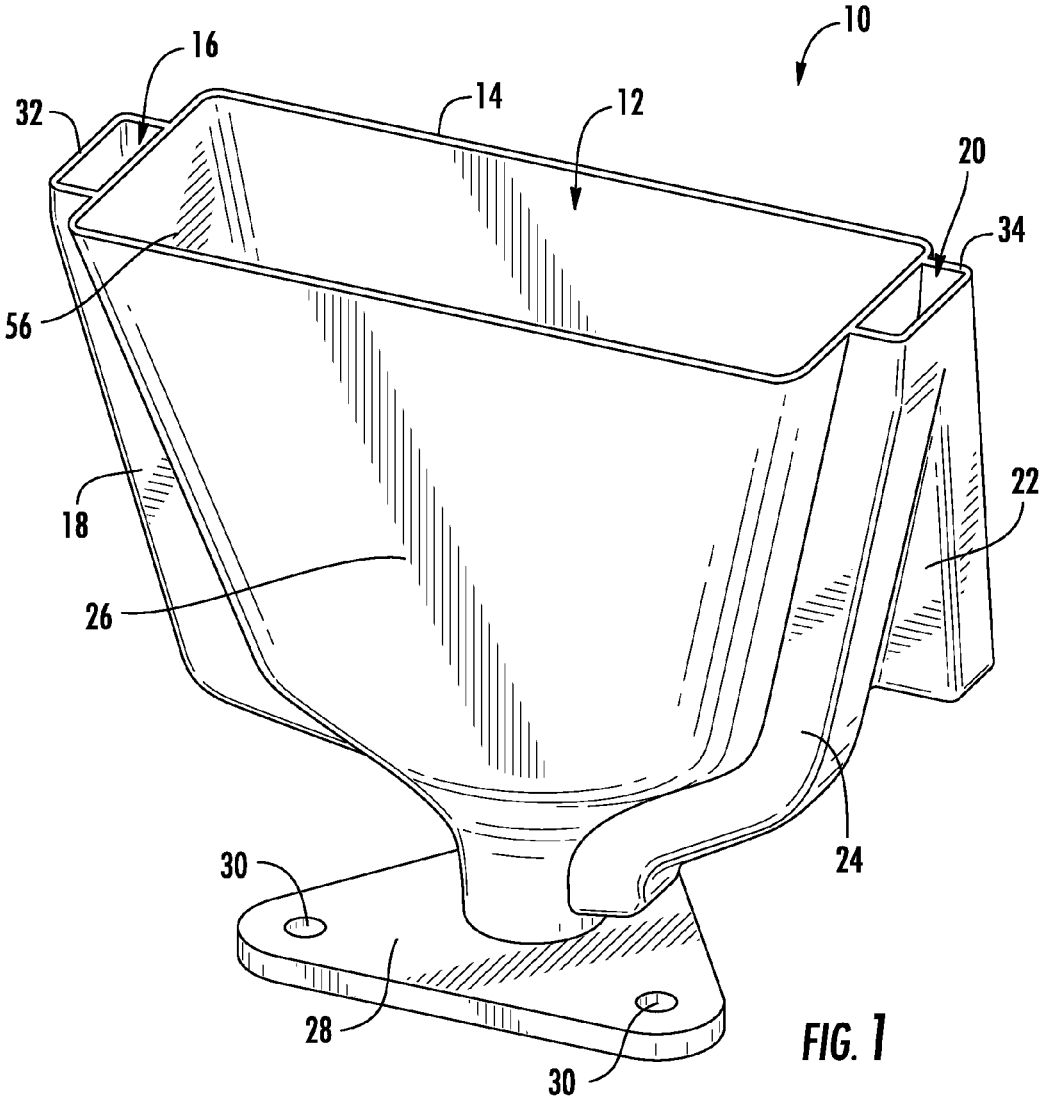
FIG. 1 is a perspective view of a multi-chamber tank for a water tank system for use with a toilet according to an exemplary embodiment.
Figure 2:
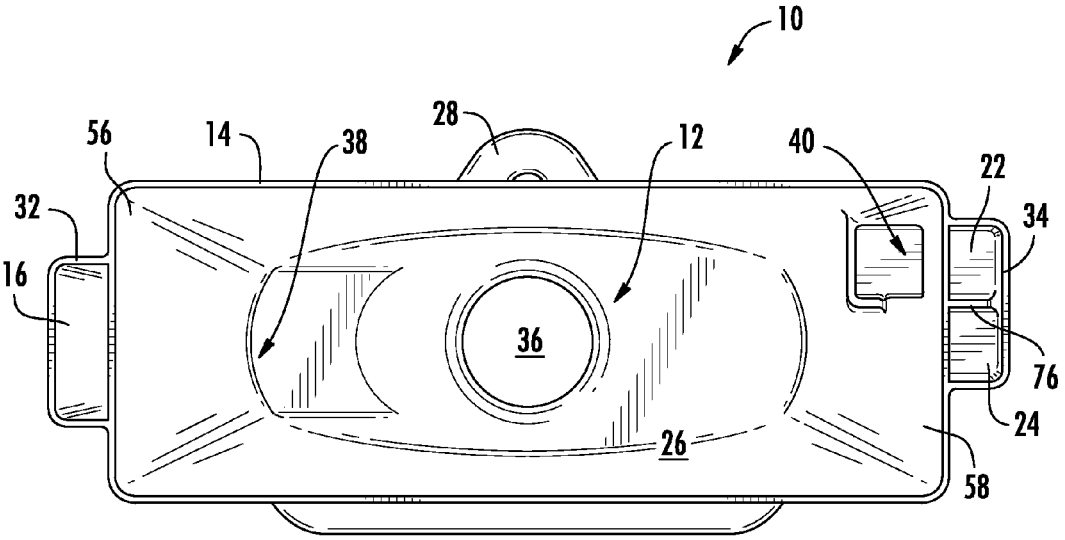
FIG. 2 is a top view of the multi-chamber tank of FIG. 1.
Figure 3:
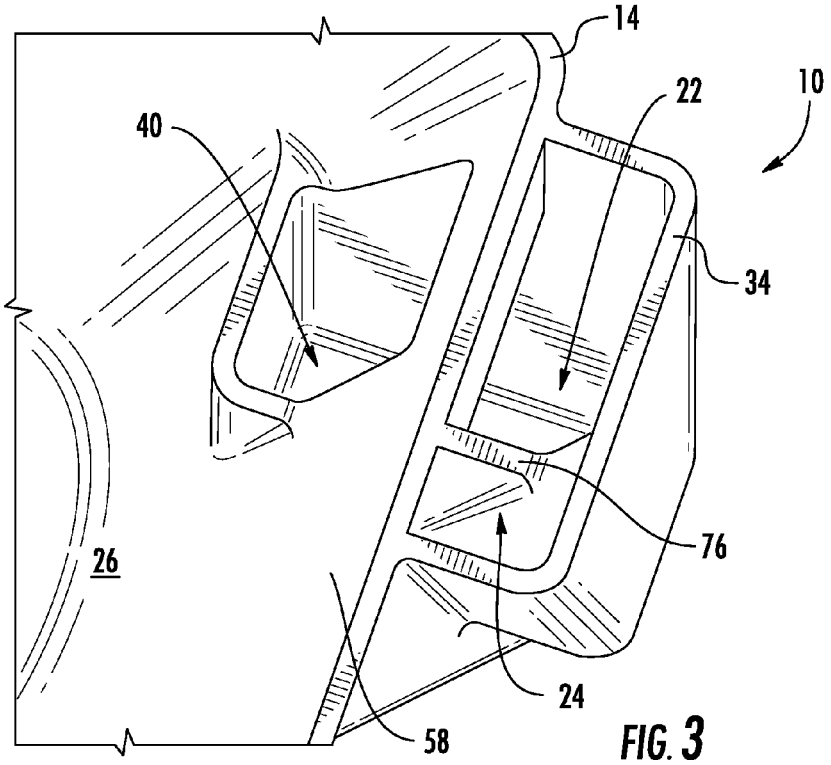
FIG. 3 is a close-up view of a main vent for the multi-chamber tank of FIG. 1.
Figure 4:
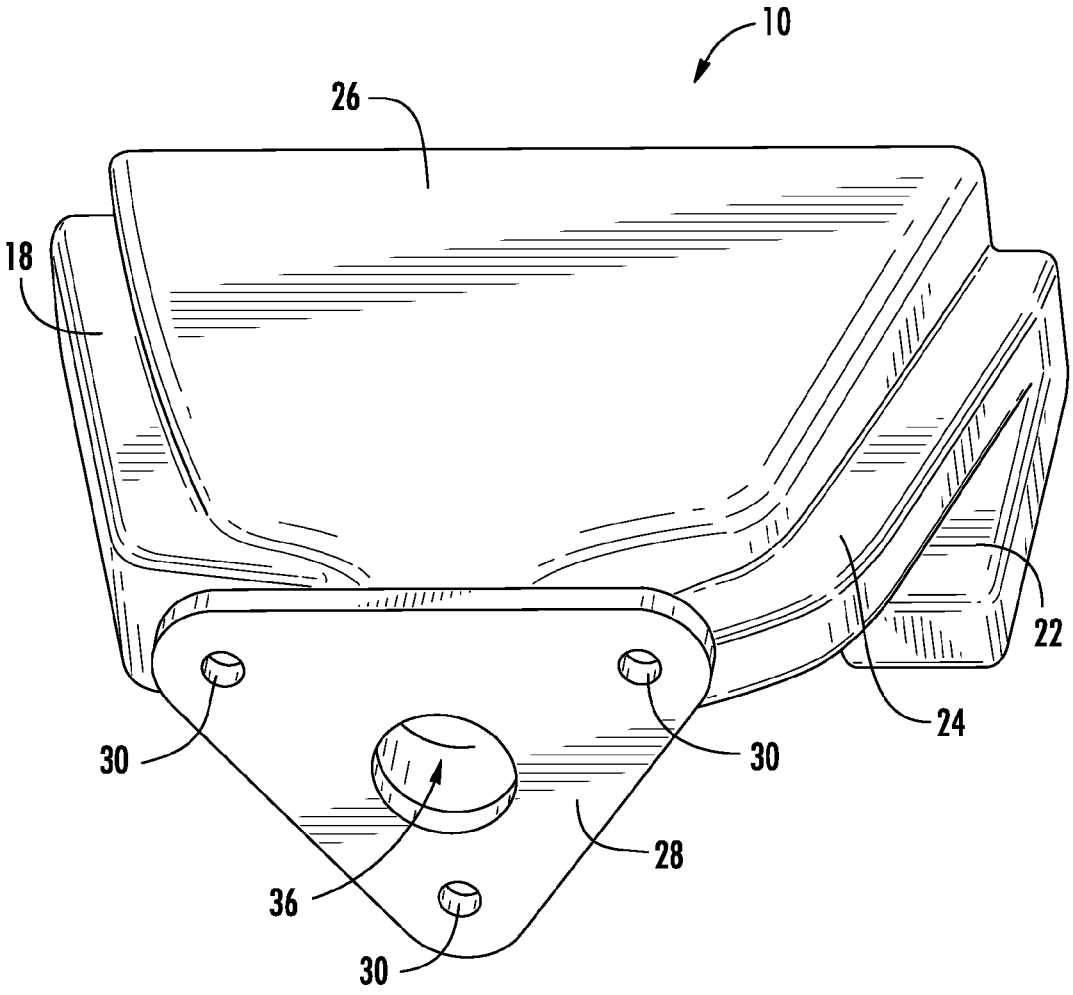
FIG. 4 is a bottom perspective view of the multi-chamber tank of FIG. 1.
Figure 5:
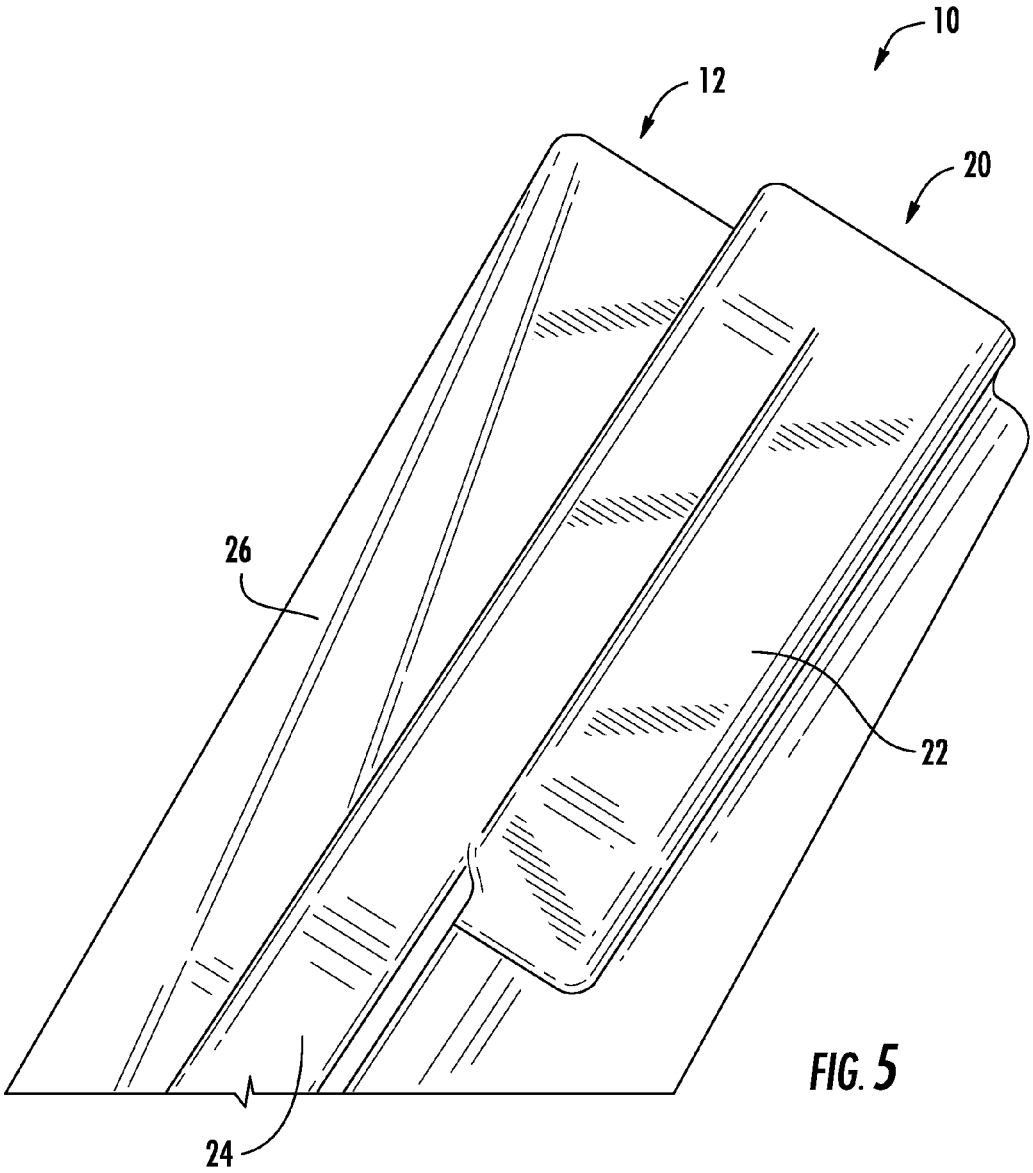
FIG. 5 is a side partial view of the multi-chamber tank of FIG. 1.

Referring to the FIGURES generally, various embodiments disclosed herein relate to an improved toilet tank system for a toilet that utilizes multiple chambers within a toilet tank to provide the flush functionality for the toilet. Other embodiments disclosed herein relate to an improved toilet tank system that utilizes a free-floating member and an actuator to provide the flush functionality for the toilet.

According to an exemplary embodiment, a multi-chamber water tank may be used by itself or may be configured to fit within an external tank of the toilet (i.e., the tank that is visible to a user of the toilet), such that the multi-chamber tank may be used with a wide variety of toilet tank designs. That is, according to an exemplary embodiment in which the multi-chamber water tank is used within another toilet tank having an exterior surface visible to the toilet user, the multi-chamber water tank is isolated from the external tank of the toilet so that the shape and/or size of the external tank do not affect the performance of the toilet (e.g., the effectiveness of the flush function, etc.). The multi-chamber water tank includes few moving parts, reducing the number of parts or components within the toilet that require service and/or replacement. Further, the multi-chamber water tank is shaped to increase the velocity at which water flows from the tank to the associated toilet bowl, potentially reducing the amount of water necessary for each flush.

According to an exemplary embodiment, the multi-chamber water tank includes a main flush chamber that is configured to hold the majority of the water used during a flush cycle. The main flush chamber is configured to hold a volume of water that may be used to re-fill the toilet bowl as part of the flush function of the toilet, and a volume of air is located above the volume of water within the main flush chamber. The main flush chamber may have angled walls or an otherwise funneled shape that is configured to force water within the main flush chamber toward an orifice fluidly connected to the toilet bowl and located below the main flush chamber.

The multi-chamber water tank may include a pressure chamber fluidly connected to the main flush chamber that is configured to store a volume of water and/or a volume of air. The pressure chamber may be fluidly connected to the outside atmosphere by an actuatable valve configured to selectively release air from the multi-chamber tank. When the actuatable valve is closed and the toilet is in a rest position (i.e., before a flush cycle is initiated), the pressure chamber maintains a positive pressure, preventing water from completely filling the pressure chamber (i.e., since the air is compressed in the space above the water within the pressure chamber). As air is released from the pressure chamber through the actuatable valve, water from the main flush chamber may fill the empty space within the pressure chamber, lowering the volume of water within the main flush chamber and creating a vacuum in the air space above the volume of water within the main flush chamber.

The multi-chamber tank also includes an overflow chamber fluidly connected to the main flush chamber. The overflow chamber is configured to receive any water from the main flush chamber that rises above a specified water level in order to prevent water from flowing out of the multi-chamber tank when excess water is introduced into the system (e.g., when a fill valve remains open, sending excess water into the multi-chamber tank, etc.). The overflow chamber may also fluidly connect the main flush chamber to the outside atmosphere when the overflow chamber and main vent are not filled with water. The multi-chamber tank may also include a main vent fluidly connected to the main flush chamber. The main vent is configured to fill with a volume of water to a height within the multi-chamber water tank approximately equal with the water level within the main flush chamber. The main vent is also fluidly connected to the outside atmosphere and configured to resist air entry from the outside atmosphere (i.e., by the volume of water within the main vent) while a vacuum (e.g., negative pressure) is created within the main flush chamber.

The multi-chamber water tank system also includes a free-floating object or member such as a flush ball positioned within the multi-chamber water tank that is configured to freely float within the multi-chamber water tank in response to a pressure differential, without being connected/coupled to any other component within the water tank. For instance, the flush ball may be positioned within or proximate to the orifice of the multi-chamber tank so as to selectively block and un-block the orifice, to control the water leaving the tank through the orifice. When the pressure below the flush ball (i.e., within the orifice) is greater than the pressure above the flush ball, the flush ball may be pushed up and away from the orifice to allow water from the main flush chamber to exit the multi-chamber tank unrestricted (e.g., unimpeded, uninterrupted, etc.) by the flush ball through the orifice.

According to other exemplary embodiments, a single or multi-chamber water tank includes a free-floating member in the form of a flush ball and an actuator to provide the flush functionality for the toilet, thereby eliminating the need for a pressure chamber and/or an overflow chamber to create a pressure differential within the water tank. According to an exemplary embodiment, the flush ball is positioned proximate to an orifice of the water tank so as to selectively block and un-block the orifice, to control water leaving the tank through the orifice. The tank further includes an actuator for selectively contacting and disengaging (e.g., unseating) the flush ball from the orifice to provide the flush functionality. The flush ball is configured to freely float within the water tank without being connected to any other component when the flush ball is selectively disengaged from the orifice.

According to an exemplary embodiment, the actuator is a slide member configured to selectively move (e.g., slide, translate, etc.) within the water tank to contact and disengage the flush ball from the orifice. According to another exemplary embodiment, the actuator is a pivot member configured to selectively pivot relative to the flush ball to lift and disengage the flush ball from the orifice. In both exemplary embodiments, the flush ball is configured to automatically re-seat itself over the orifice by way of water flowing from the tank to the orifice without the need for chains, tethers, or any other elements for guiding the flush ball. In this manner, the water tank achieves effective and reliable flushing without the use of traditional flapper valves, which can wear prematurely after repeated use and can restrict/impede water flow to the orifice. Furthermore, the water tank does not require the use of guides or other similar elements for directing the flush ball to a seated position over the orifice.

Figure 6:
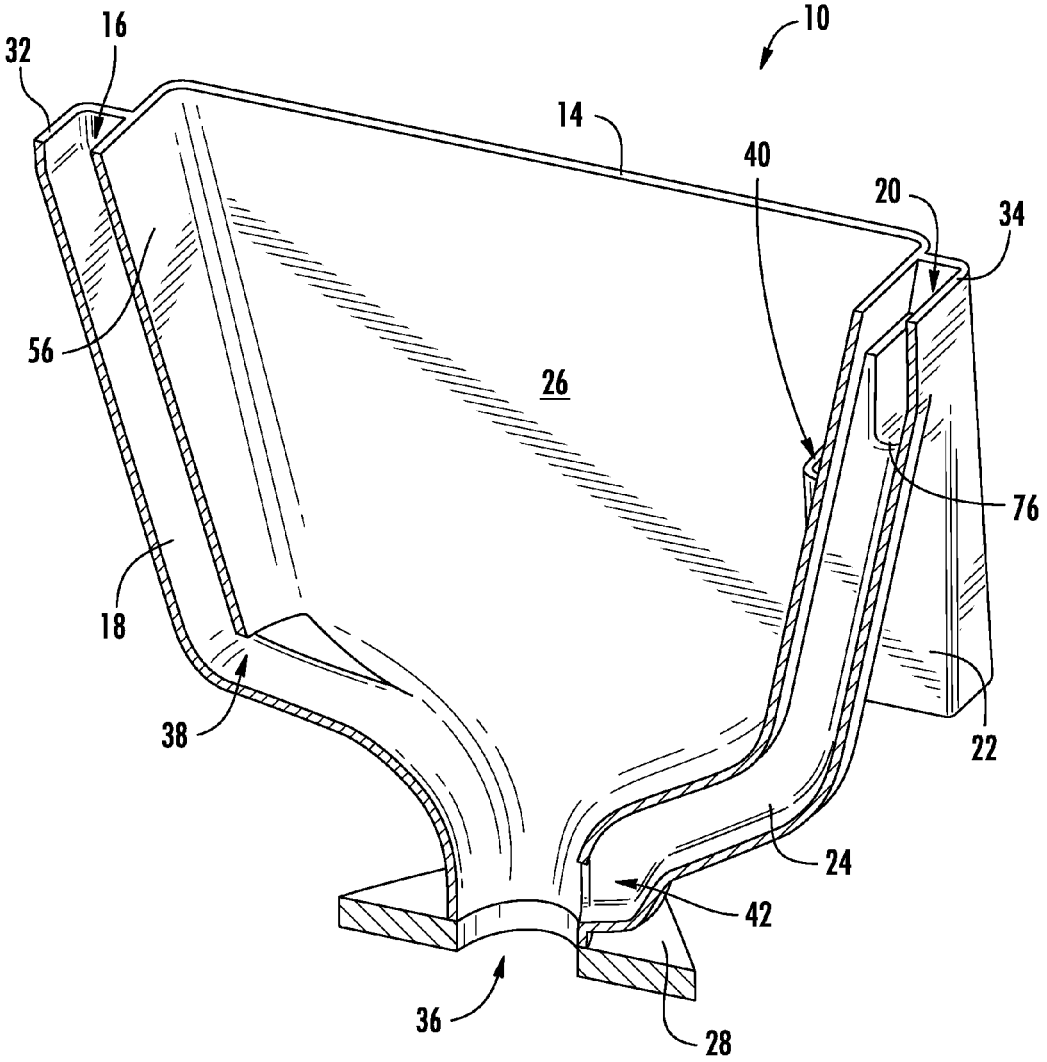
FIG. 6 is a cross-sectional view of the multi-chamber tank of FIG. 1.
Figure 7:
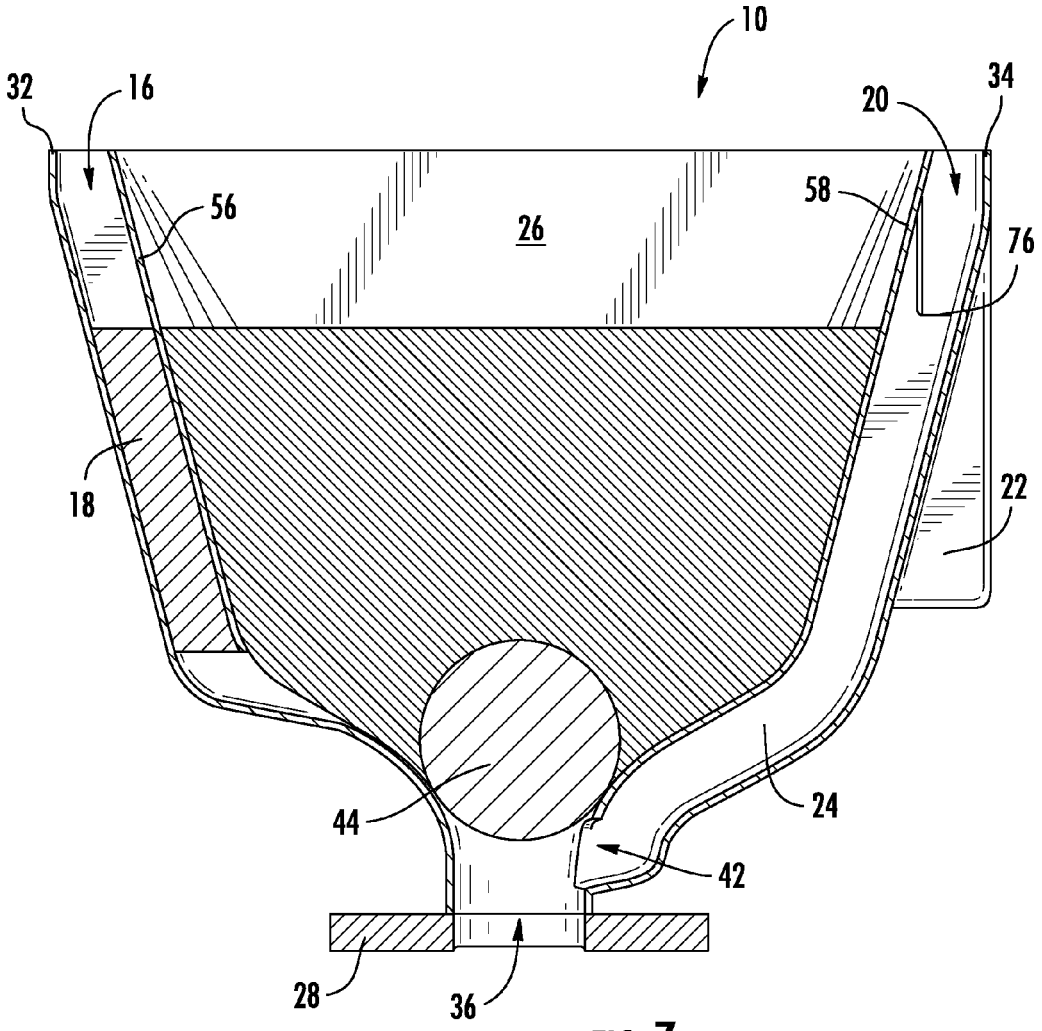
FIG. 7 is a cross-sectional view of the multi-chamber tank, including a flush ball covering an orifice, according to an exemplary embodiment.
Figure 17:
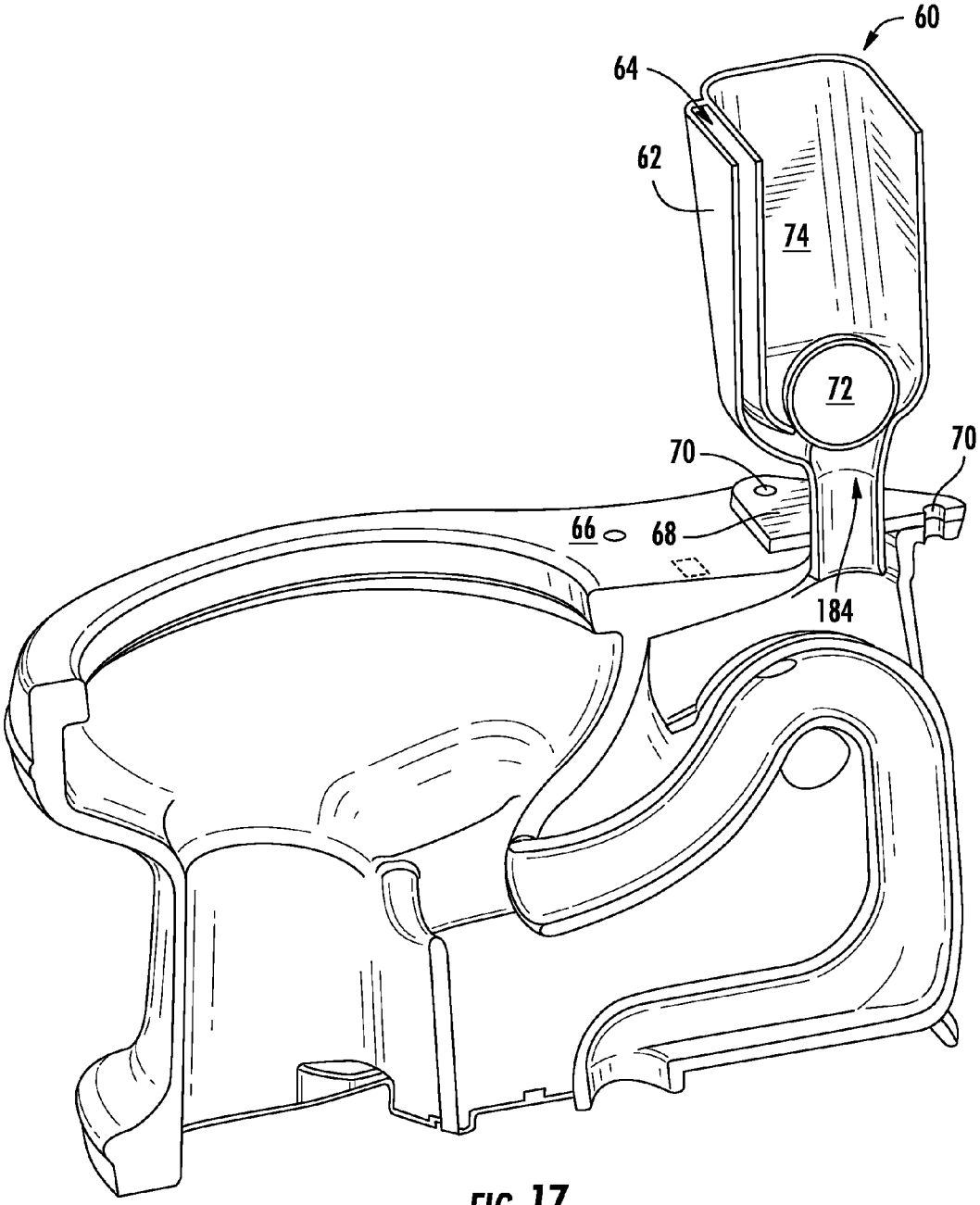
FIG. 17 is a cross-sectional view of the multi-chamber tank and the toilet bowl of FIG. 16.

Referring now to FIGS. 1-7, a multi-chamber tank 10 for a toilet water tank system (i.e., water tank assembly) is shown according to an exemplary embodiment. The multi-chamber tank 10 includes a flush chamber 26 (i.e., compartment, cavity, etc.) having a top opening 12 formed by an outer edge 14. In this embodiment, the outer edge 14 has a substantially rectangular shape, forming a substantially rectangular top opening 12. In other embodiments, the outer edge 14 and the top opening 12 may have another shape, as may be suitable for the particular application of the flush chamber 26 and/or the multi-chamber tank 10 in those embodiments. With reference to FIGS. 1, 6, and 7, the flush chamber 26 is shown to have what could generally be referred to as a "funnel" shape (i.e., V-shape, U-shape), in which the width of the chamber decreases from a first width at the top of the flush chamber 26 (i.e., near the top opening 12) to a smaller second width at the bottom of the flush chamber 26 (according to FIG. 1). In this embodiment, water or other liquid is funneled through the flush chamber 26 and/or other chambers of the multi-chamber tank 10 into a primary orifice 36 (i.e., opening, funnel, hole) positioned beneath the flush chamber 26 and at the bottom of the multi-chamber tank 10. The primary orifice 36 may fluidly connect the multi-chamber tank 10 to a toilet bowl (shown by way of example in FIG. 17). The multi-chamber tank 10 may also have an overall shape that mimics the shape of the flush chamber. For example, the exterior shape of the tank may have a generally funnel-shaped configuration. According to other exemplary embodiments, the shape of the exterior of the tank may differ, and is not necessarily dictated by the shape of the internal main chamber.

In an exemplary embodiment, the multi-chamber tank 10 includes a pressure chamber 18 fluidly connected to the flush chamber 26. The pressure chamber 18 has a top opening 16 located at the top of the pressure chamber 18 (according to FIG. 1), fluidly connecting the pressure chamber 18 to the outside atmosphere. A substantially rectangular edge 32 and a portion of the outer edge 14 form the top opening 16. The opening 16 and the edge 32 are substantially rectangular in the illustrated embodiment of FIGS. 1-7, but the opening 16 and the edge 32 may have another shape in other embodiments, as may be suitable for the particular application of the multi-chamber tank 10. In the illustrated embodiment of FIGS. 1-7, the pressure chamber 18 is connected to the flush chamber 26, sharing a side wall 56 of the flush chamber 26. The pressure chamber 18 is fluidly connected to the flush chamber 26 by an opening 38 (shown in FIG. 6) below the bottom of the side wall 56. The pressure chamber 18 is slanted or curved toward the opening 38 to accommodate the shape of the flush chamber 26. The pressure chamber 18 may be configured to direct air toward the opening 38. When the primary orifice 36 is clear (i.e., open, unplugged), water within the pressure chamber 18 may be directed toward the opening 38 to exit the multi-chamber tank 10 through the primary orifice 36.

The multi-chamber tank 10 also includes a main vent 22 and an overflow chamber 24 that are both fluidly connected to the flush chamber 26. The main vent 22 and the overflow chamber 24 are fluidly connected to the outside atmosphere by a top opening 20. A substantially rectangular edge 34 and a portion of the outer edge 14 form the top opening 20. An intersecting wall 76 is positioned within the top opening 20, dividing the main vent 22 from the overflow chamber 24. The top opening 20 is adjacent to the top opening 12 of the flush chamber 26, each being formed by at least a portion of the outer edge 14. The top opening 20 and the edge 34 are shown to be substantially rectangular in FIGS. 1-7, but the opening 20 and the edge 34 may have other shapes in other embodiments, as may be suitable for the particular application of the multi-chamber tank 10. The top opening 20 is positioned opposite the top opening 16, with the edges 32 and 34 being positioned on opposite sides of the multi-chamber tank 10.

In an exemplary embodiment, the overflow chamber 24 is connected to the flush chamber 26, sharing a side wall 58 of the flush chamber 26. The overflow chamber 24 is fluidly connected at an upper portion thereof to the flush chamber 26 by an opening 40 (shown in FIG. 6) formed at the top of the flush chamber 26 within the side wall 58. The overflow chamber 24 is configured to receive water from the flush chamber 26 when the water level within the flush chamber 26 exceeds a predetermined height. In an exemplary embodiment, the predetermined height is selected so that a specific ratio of water to air is maintained within the flush chamber 26. In the illustrated embodiment of FIGS. 1-7, the overflow chamber 24 receives water that rises above (e.g., exceeds) the height of the intersecting wall 76. Water received by the overflow chamber 24 (i.e., water that exceeds the height of the intersecting wall 76) is directed/forced into a bottom portion 42 of the overflow chamber 24. In some embodiments, the bottom portion 42 includes a valve (not shown) for releasing the water into the primary orifice 36 to empty the overflow chamber 24. In the illustrated embodiment of FIGS. 1-7, the overflow chamber 24 is slanted or curved from the upper portion toward the bottom portion 42 to accommodate the shape of the flush chamber 26, having a substantially uniform width from the top opening 20 to the opening 42. However, in other embodiments the overflow chamber 24 may have another shape and/or width, as may be suitable for the particular application of the overflow chamber 24 and/or multi-chamber tank 10. The overflow chamber 24 is described in further detail below.

The main vent 22 is also connected to the flush chamber 26, sharing the side wall 58 with the flush chamber 26. The main vent 22 is fluidly connected to the flush chamber 26 by an opening 40 formed within the side wall 58. In an exemplary embodiment, the main vent 22 has a height of approximately 3 inches from the bottom of the main vent 22 to the opening 20. In other embodiments, the main vent 22 may have other dimensions, as may be suitable for the particular application of the multi-chamber tank 10. Like the overflow chamber 24, the main vent 22 is connected to the outside atmosphere by the opening 20. The main vent 22 and the overflow chamber 24 are separated or compartmentalized by the intersecting wall 76. The wall 76 prevents fluid below the wall 76 from traveling between the main vent 22 and the overflow chamber 24. The main vent 22 is described in further detail below.

Figure 16:
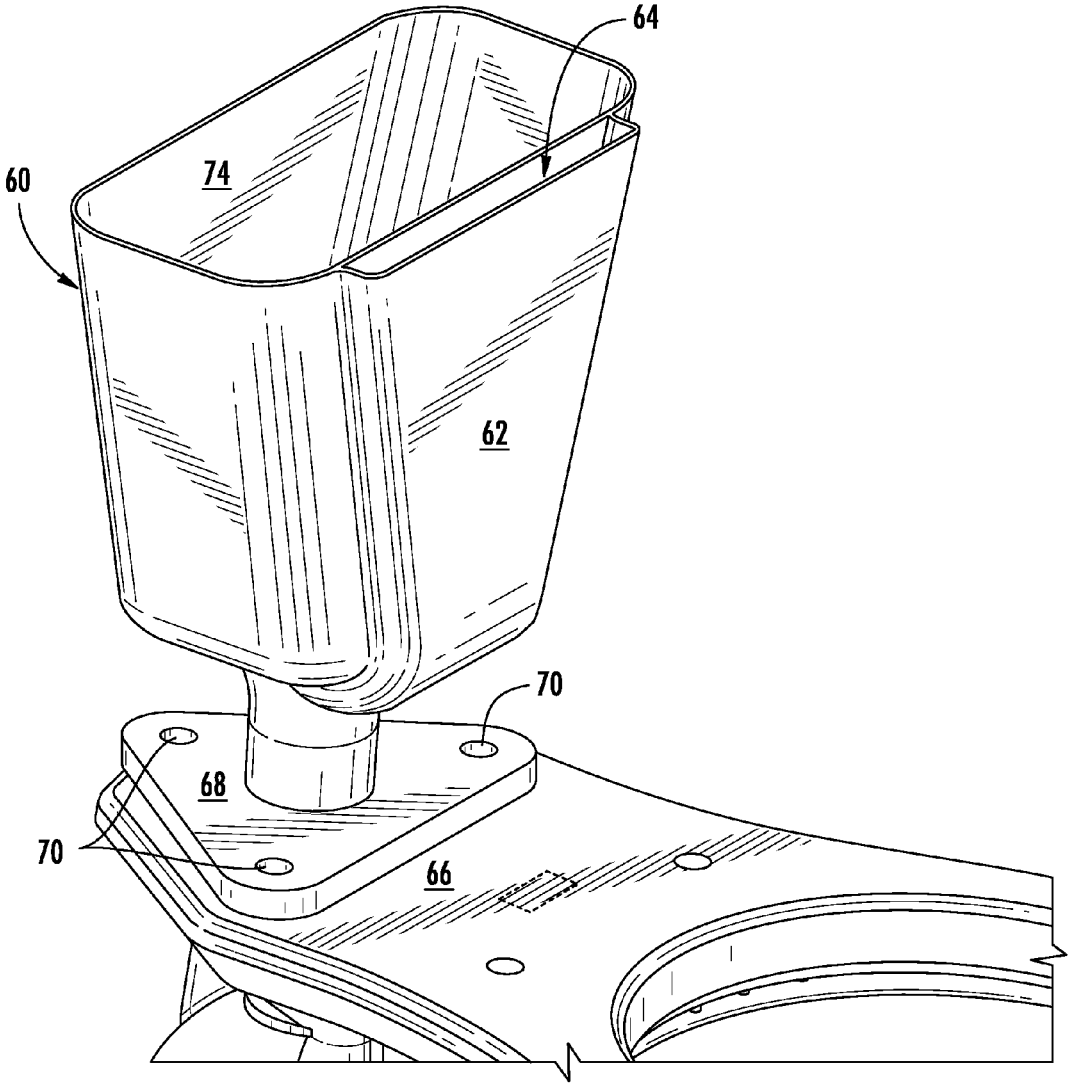
FIG. 16 is a perspective view of a multi-chamber tank connected to a toilet bowl according to an exemplary embodiment.

The multi-chamber tank 10 also includes a base 28 (i.e., stand, connector, joint, link) for connecting the multi-chamber tank 10 to a toilet bowl or toilet bowl structure. In an exemplary embodiment, the multi-chamber tank 10 is connected to a toilet bowl by one or more fasteners that are fastened to the toilet bowl through slots 30. The base 28 is secured to the toilet bowl so that the primary orifice 36 is fluidly connected to the toilet bowl in order to transfer fluid between the multi-chamber tank 10 and the toilet bowl. In an exemplary embodiment, the base 28 connects to the toilet bowl such that the multi-chamber tank 10 stands upright on the toilet bowl according to the orientation shown in FIG. 1. The base 28 is generally triangular in the illustrated embodiment of FIGS. 1-7, and includes three slots 30 configured to receive fasteners for attaching the multi-chamber tank 10 to a toilet bowl. However, in other embodiments, the base 28 may have another shape suitable for the particular application of the multi-chamber tank 10, and may include more or fewer slots for fasteners as necessary or desired. Fasteners 46 are shown by way of example in FIG. 8A and described below. Multi-chamber tank 60 is shown connected to toilet bowl 66 in FIGS. 16 and 17 and described below. It should be noted that according to other exemplary embodiments, the tank may be coupled indirectly to the toilet bowl or an associated structure thereof. For example, the tank may be placed within and coupled directly to another toilet tank that forms the visible exterior surface of the toilet's tank (e.g., a tank component that substantially conceals, obscures, or shrouds the internal water tank from view), and the "exterior" toilet tank may be coupled to the base or bowl of the toilet. According to still other exemplary embodiments the tank may not be directly fastened to the toilet base or bowl, but may be part of an in-wall tank system that is concealed behind a wall or other structure to which the toilet bowl is positioned (or which is positioned in front of the wall or structure).

The multi-chamber tank 10, including the flush chamber 26, overflow chamber 24, main vent 22, and the pressure chamber 18, may be made from a molded plastic material according to an exemplary embodiment. The multi-chamber tank 10 may be made from a single molded piece, or the multi-chamber tank 10 may be made from multiple pieces. For instance, in some embodiments, the flush chamber 26, overflow chamber 24, main vent 22, and the pressure chamber 18 may each be made from a separate molded piece that are then coupled together to produce the finished assembly. In other embodiments, the multi-chamber tank 10 and its components (e.g., flush chamber 26, overflow chamber 24, etc.) may be made from a non-plastic material suitable for the particular application of the multi-chamber tank 10 and/or the tank system of the present disclosure (e.g., vitreous china, composite materials, etc.).

A cover or lid may be provided over the top of the multi-chamber tank, as shown generally in FIGS. 8B, 9B, 10B, 11B, 12B, 13B, and 14B. The lid may act to seal the various chambers of the multi-chamber tank from each other and from the outside atmosphere so as to maintain the pressure profile within the multi-chamber tank. The lid may cover one or more of the top openings 12, 16, and/or 20, and may be made from the same material as the multi-chamber tank 10, such as molded plastic, or may be made from another material suitable for the particular application. The lid may also include a gasket (not shown) or seal to create a seal around any or all of the top openings 12, 16, and/or 20. In other embodiments, the multi-chamber tank 10 does not include a lid, and may be shaped and/or designed to not require a lid. Other embodiments of the multi-chamber tank 10 and the multi-chamber tank system are shown in FIGS. 16-32 and described in further detail below.

In some embodiments, the multi-chamber tank 10 may be used in conjunction with another component that conceals, covers, or shrouds the multi-chamber tank, as illustrated in the embodiments shown in FIGS. 23-26 (hereinafter referred to as a "shroud" or "cover"). The shroud may have a configuration or design that is aesthetically pleasing and in harmony with that of the base or bowl of the toilet (e.g., it may have the appearance of a typical toilet tank such that a casual observer of the toilet may not appreciate that the toilet includes an internal multi-chamber tank). One advantageous feature of such a configuration is that the same multi-chamber tank may be used with a wide variety of different shrouds or external tanks, without the need to re-test and re-validate every different shroud/external tank configuration.

The shroud may substantially surround the multi-chamber tank or may have portions that are open. For example, the shroud may have an open back or a hole in its back surface to allow access to the toilet tank. In some embodiments, portions of a toilet's tank may not be readily observable to a toilet user (e.g., the back of the tank may be positioned against a wall). In such cases, it may be advantageous to employ a shroud that has an open back, since doing so would allow reduced manufacturing costs and provide material savings for the shroud, especially in cases where the shroud is formed of a relatively costly material such as vitreous china or the like.

Referring now to FIG. 7, as part of the multi-chamber tank system, the multi-chamber tank 10 may include a member or element in the form of a float such as a flush ball 44 that is sized and shaped to selectively engage and block the flow of water through the primary orifice 36. In the illustrated embodiment of FIG. 7, the flush ball 44 has a diameter greater than the diameter of the primary orifice 36, such that the flush ball 44 is seated or rests partially within the primary orifice 36. In an exemplary embodiment, the flush ball 44 has a diameter of approximately 3 inches, and the primary orifice 36 has a diameter at the flush chamber 26 of approximately 2.5 inches. In other embodiments, the ratio of the diameter of the flush ball 44 to the diameter of the primary orifice 36 is approximately 6 to 5. In still other embodiments, the flush ball 44 (i.e., object) and the primary orifice 36 may each have another diameter, shape, and/or size, as may be suitable for the particular application of the flush ball 44 and the multi-chamber tank 10. In an exemplary embodiment, the flush ball 44 is buoyant, such that the flush ball 44 is configured to move within the flush chamber 26 in response to a pressure (e.g., air pressure, water pressure, vacuum pressure, etc.). The function of the flush ball 44 is described in further detail below in reference to the flush cycle described with reference to FIGS. 8-14.

Figure 8B:
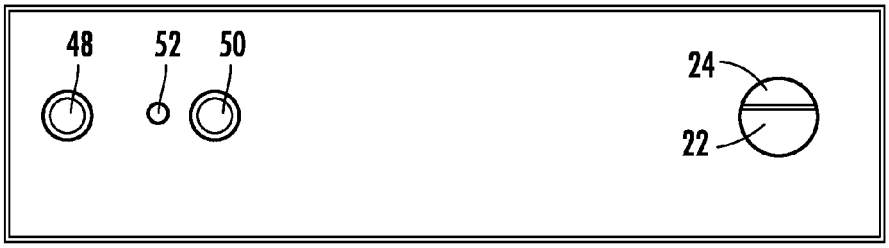
FIGS. 8A-8B are schematic views of the water tank system of the present disclosure at rest according to an exemplary embodiment.
Figure 8A:
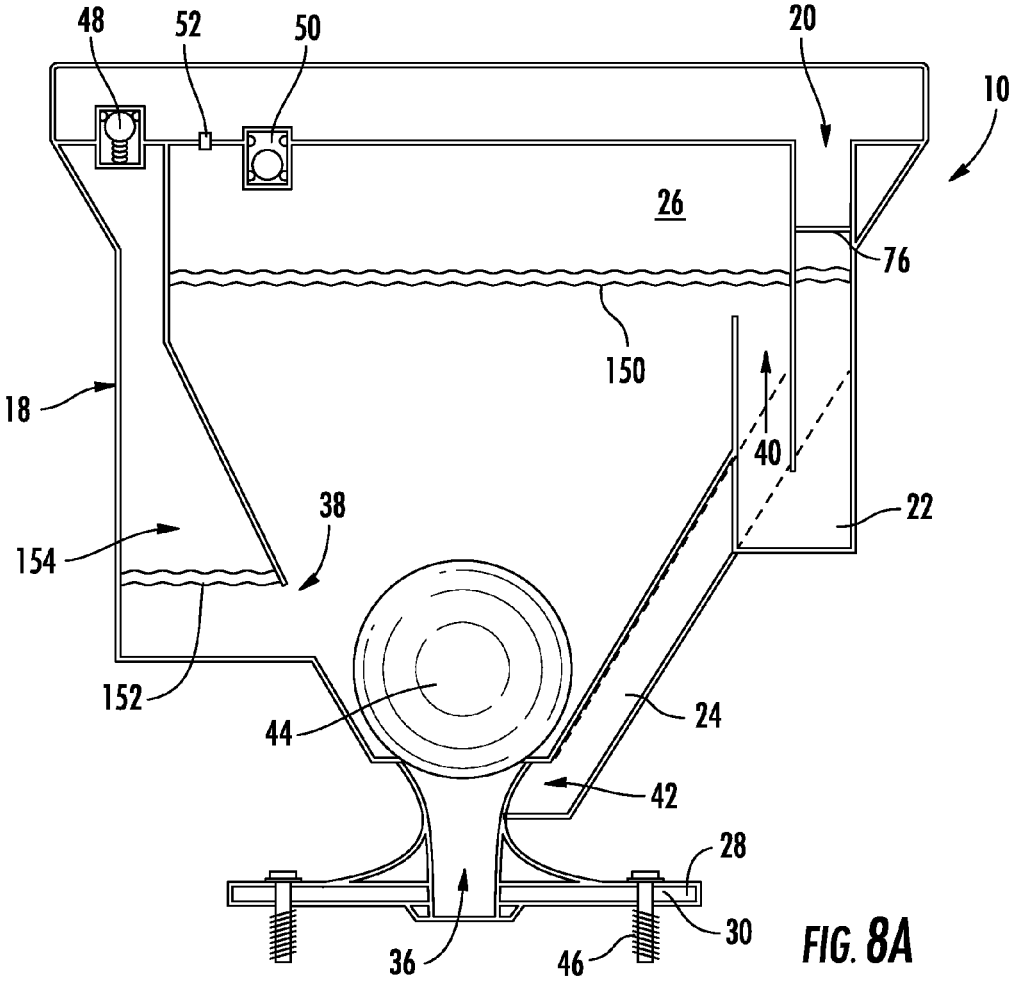
Figure 32:
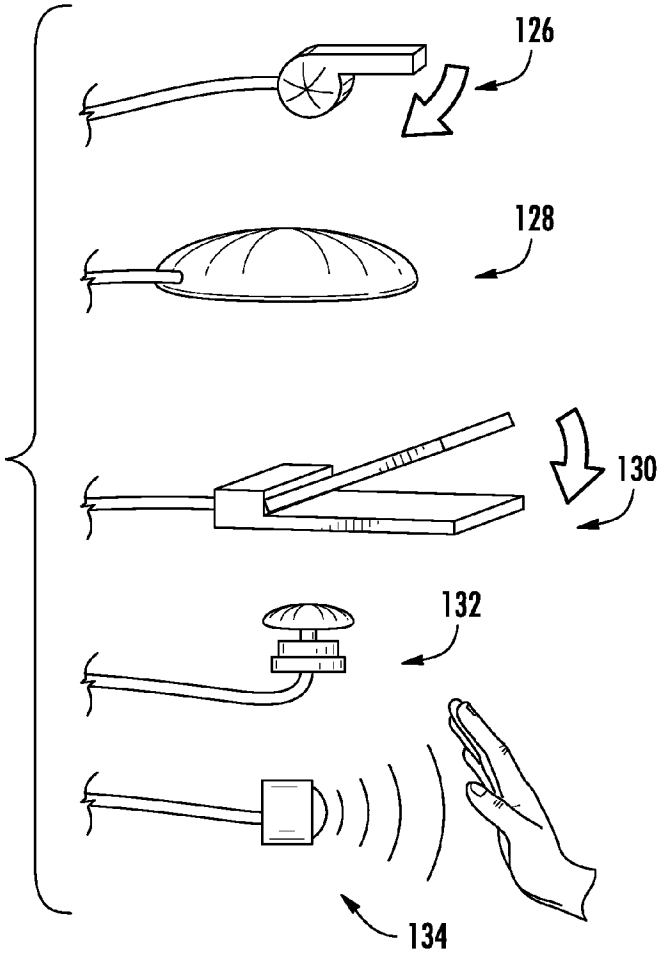
FIG. 32 is an illustration of flush actuators for the water tank system of the present disclosure according to exemplary embodiments.

Referring now to FIGS. 8A and 8B, the multi-chamber tank system is shown according to an exemplary embodiment. In this embodiment, the multi-chamber tank system includes a lid shown in FIG. 8B that includes a check valve 48 (i.e., actuator valve, actuator check valve) fluidly connecting the pressure chamber 18 to the outside atmosphere. In an exemplary embodiment, the check valve 48 is used to release a pressure within the pressure chamber 18 in order to facilitate a flush function of the multi-chamber tank system. The check valve 48 has an open position for fluidly connecting the pressure chamber 18 to the outside atmosphere, and an open position for sealing the pressure chamber 18 from the outside atmosphere. In an exemplary embodiment, the check valve 48 remains closed when the multi-chamber tank system is at rest, and the check valve 48 may be actuated or triggered to move to the open position. The check valve 48 may be configured to automatically move to the closed position after a predetermined time, sealing the pressure chamber 18, or the check valve 48 may be otherwise triggered or actuated again to move to the closed position. A check valve actuator, such as a trip handle 126 or other type of actuator, some of which are illustrated in FIG. 32, may be connected to the check valve 48 in order to trigger or actuate (e.g., open, close, release, etc.) the check valve 48. In an exemplary embodiment, the trip handle 126 or other actuator is used to actuate the flush cycle or function of the multi-chamber tank system, moving the check valve 48 to the open position and releasing a pressure within the multi-chamber tank 10.

The multi-chamber tank system also includes a check valve 50 (i.e., pressure valve, pressure release valve, positive pressure release valve) configured to fluidly connect the flush chamber 26 to the outside atmosphere. The check valve 50 has an open position for fluidly connecting the flush chamber 26 to the outside atmosphere and a closed position for sealing the flush chamber 26 from the outside atmosphere. In an exemplary embodiment, the check valve 50 is used to release a pressure or provide a positive pressure release within the flush chamber 26. The check valve 50 may be triggered or actuated as part of the multi-chamber tank system. In an exemplary embodiment, the check valve 50 is triggered or actuated to move the check valve 50 to the open position, releasing excess air pressure that is displaced from the multi-chamber tank during the flush cycle. The check valve 50 may move to the closed position after a predetermined time or period of time, or the check valve 50 may be otherwise triggered or actuated to move to the closed position.

The multi-chamber tank system may also include a vent hole 52 (i.e., pin-hole vent) for venting air from the flush chamber 26. The vent hole 52 may remain open at all times, or may be selectively opened by an actuator or otherwise to vent air from the flush chamber 26. The multi-chamber tank system also includes fasteners 46 for connecting the multi-chamber tank 10 to a toilet bowl. The fasteners 46 are inserted through the slots 30 in order to attach the base 28 to the toilet bowl and couple the multi-chamber tank 10 to the toilet bowl. In an exemplary embodiment, the multi-chamber tank 10 is fluidly connected to the toilet bowl by the primary orifice 36.

FIGS. 8-14 illustrate the multi-chamber tank system in various stages of a flush cycle according to an exemplary embodiment. FIGS. 8A and 8B show the multi-chamber tank system at rest (i.e., before the flush function has been actuated) according to an exemplary embodiment. FIG. 8A shows a front view and FIG. 8B shows a top view of the multi-chamber tank system. When the multi-chamber tank 10 is at rest, the flush chamber 26 contains a volume of water (i.e., flush chamber water volume) at a water level 150 and a volume of air (i.e., flush chamber air volume) within an air space above the water. The pressure within the air space below the flush ball 44 (i.e., within the primary orifice 36) is less than or equal to the pressure within the air space of the flush chamber 26, applying a positive pressure to the flush ball 44 so that the flush ball 44 rests within the primary orifice 36 at the bottom of the flush chamber 26. The pressure of the air within the flush chamber 26 is approximately equal to the pressure of the air in the outer atmosphere at this point. In an exemplary embodiment, the flush chamber water volume is approximately 0.85 gallons and the flush chamber air volume is approximately 50 cubic inches. In other embodiments, the flush chamber 26 and/or multi-chamber tank 10 may have a greater or lesser fluid capacity, but may contain a similar ratio of flush chamber water volume to flush chamber air volume. In still other embodiments, the flush chamber 26 may contain another ratio of water volume to air volume, as is suitable for the particular application of the multi-chamber tank 10.

As shown in the illustrated embodiment of FIGS. 8A and 8B, the main vent 22 is fluidly connected to the flush chamber 26 such that water may also fill a portion of the main vent 22, with the water resting within the main vent 22 at a height (i.e., distance from the primary orifice 36) approximately equal to the water level 150 within the flush chamber 26. In an exemplary embodiment, the distance between the opening 40 and the water level 150 of the multi-chamber tank 10 is approximately 0.75 inches when the system is at rest.

When the multi-chamber tank system is at rest, the check valve 48 remains closed or non-actuated. The air within the pressure chamber 18 is compressed by the volume of water within the multi-chamber tank 10, maintaining a positive pressure within the closed cavity of the pressure chamber 18. In the illustrated embodiment of FIG. 8A, the pressure chamber 18 includes a volume of water resting at a water level 152 just above the opening 38 connecting the pressure chamber 18 to the flush chamber 26. The pressure chamber 18 may also contain a volume of air (i.e., a volume 154) in the space above the water within the pressure chamber 18. In an exemplary embodiment, the volume 154 within the pressure chamber 18 is large enough relative to the volume of air within the flush chamber 26 (i.e., in the space above the water level 150) such that the required momentary pressure change to perform the flush function is generated within the multi-chamber tank 10 when the check valve 48 is opened. In another exemplary embodiment, the volume of the main vent 22 is approximately equal to the active volume within the pressure chamber 18.

Figure 9B:
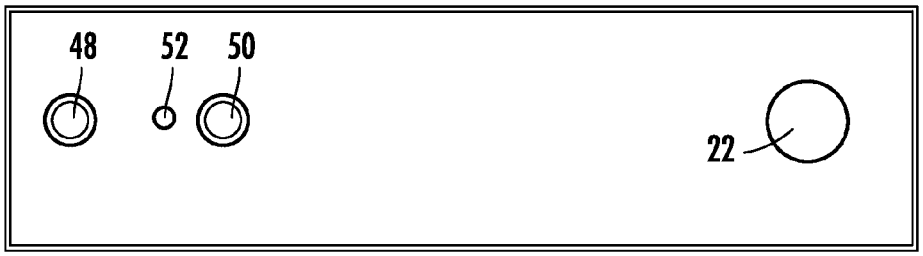
FIGS. 9A-9B are schematic views of the water tank system of the present disclosure when the flush function is actuated according to an exemplary embodiment.
Figure 9A:
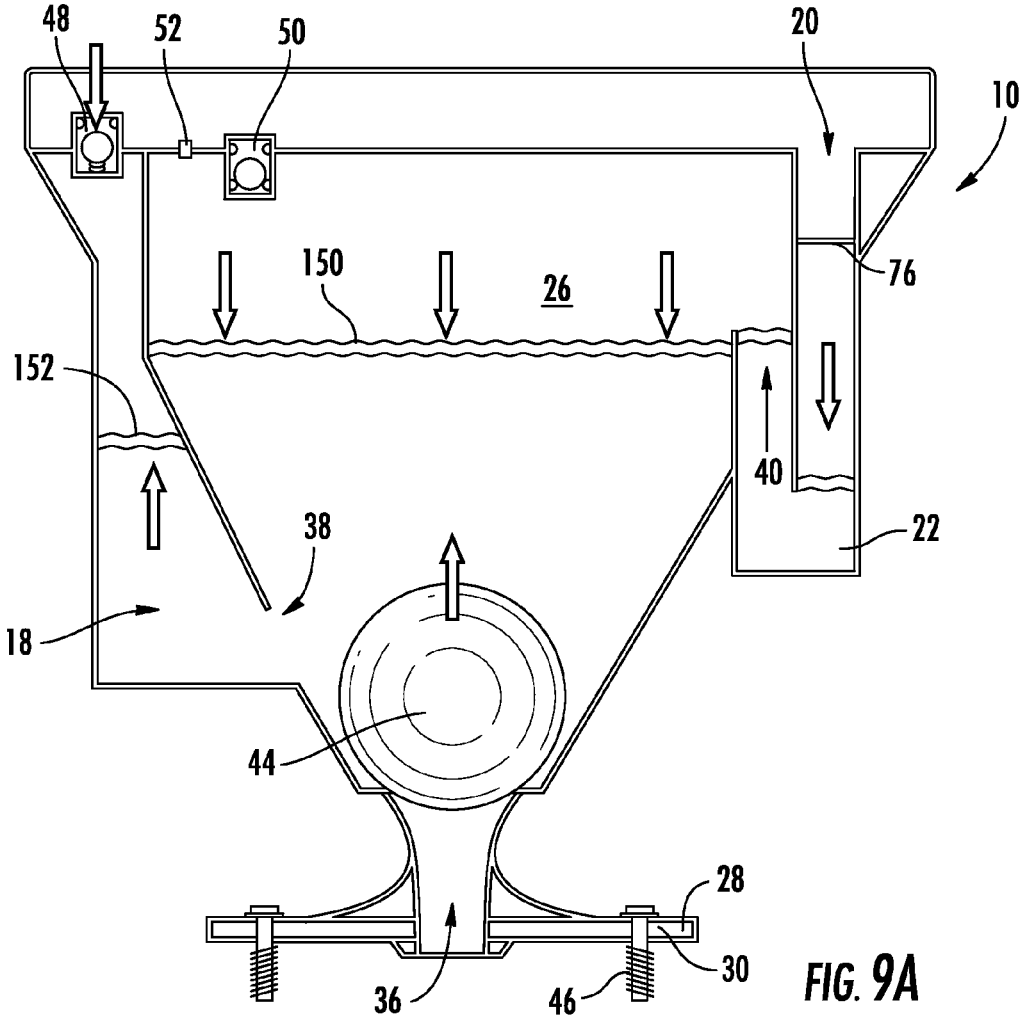

FIGS. 9A and 9B illustrate the multi-chamber tank system at the time the flush function has been actuated. FIG. 9A shows a front view and FIG. 9B shows a top view of the multi-chamber tank system. The flush function is actuated by triggering or actuating the check valve 48, opening the check valve 48. When the check valve 48 is opened, the pressure chamber 18 is fluidly connected to the outside atmosphere, allowing air to exit the pressure chamber 18 through the open check valve 48 and reducing the pressure above the water in the pressure chamber 18. With the pressure within the pressure chamber 18 reduced, water is forced from the flush chamber 26 into the pressure chamber 18 rather than being forced from the pressure chamber 18 into the flush chamber 26, raising the water level 152 within the pressure chamber 18. As water exits the flush chamber 26 through the opening 38, the water level 150 within the flush chamber 26 lowers, creating a vacuum (i.e., negative pressure) within the air space of the flush chamber 26 (i.e., above the water within the flush chamber 26). Because the air below the flush ball 44 within the primary orifice 36 is approximately at atmospheric pressure, the negative pressure above the flush ball 44 will cause the buoyant flush ball 44 to move upward (according to FIG. 9A). When the multi-chamber tank system is at rest, the main vent 22 is configured to resist air entry from the outside atmosphere. The pressure within the air space of the flush chamber 26 is at least as great as the pressure of the outside atmosphere, so that the pressure from the flush chamber 26 prevents the water from the main vent 22 from entering the flush chamber 26. However, as the vacuum is created in the air space of the flush chamber 26, the pressure within the flush chamber 26 falls below the pressure of the outside atmosphere. Thus, the water within the main vent 22 is forced through the opening 40 by the pressure of the outside atmosphere, entering the flush chamber 26 and evacuating water from the main vent 22.

Figure 10B:
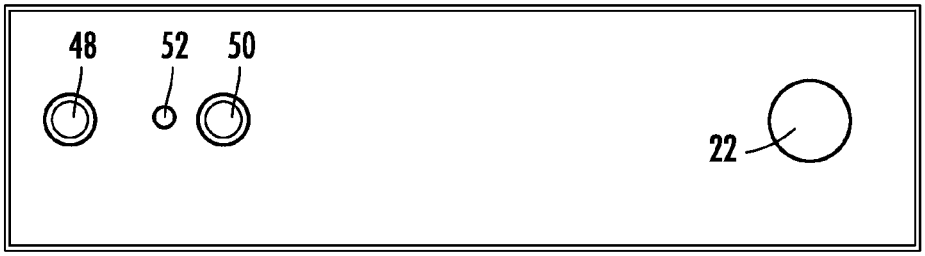
FIGS. 10A-10B are schematic views of the water tank system of the present disclosure at a first stage of the flush function according to an exemplary embodiment.
Figure 10A:
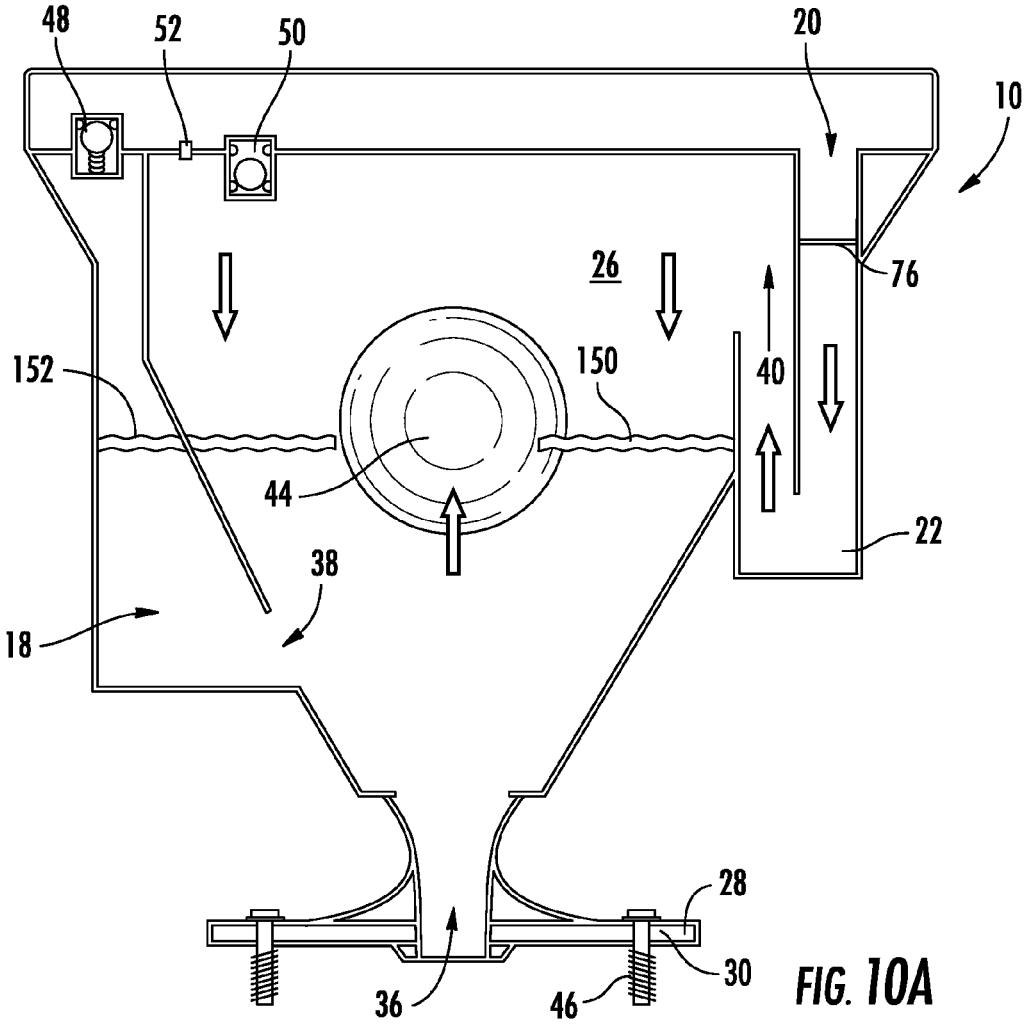

FIGS. 10A and 10B illustrate the multi-chamber tank system just after the flush function has been actuated. FIG. 10A shows a front view and FIG. 10B shows a top view of the multi-chamber tank system. The forces beneath the flush ball 44 (e.g., atmospheric pressure of the air within the primary orifice 36) overcome the forces above the flush ball 44 (e.g., negative or vacuum pressure within the flush chamber 26, etc.), causing the flush ball 44 to unseat from the primary orifice 36. With the flush ball 44 unseated, water begins to exit the flush chamber 26 through the primary orifice 36 at the bottom of the multi-chamber tank 10. As water exits the flush chamber 26, the vacuum pressure (i.e., negative pressure) in the air space of the flush chamber 26 increases from a relatively low vacuum pressure to a relatively higher vacuum pressure. The increase in negative or vacuum pressure in the air space above the water of the flush chamber 26 causes the remainder of the water within the main vent 22 to leave the main vent through the opening 40 and enter the flush chamber 26. Once the water is pulled or removed from the main vent 22, the main vent 22 provides a fluid connection from the multi-chamber tank 10 to the outer atmosphere, enabling the free exchange of air between the multi-chamber tank 10 and the outer atmosphere.

Figure 11B:
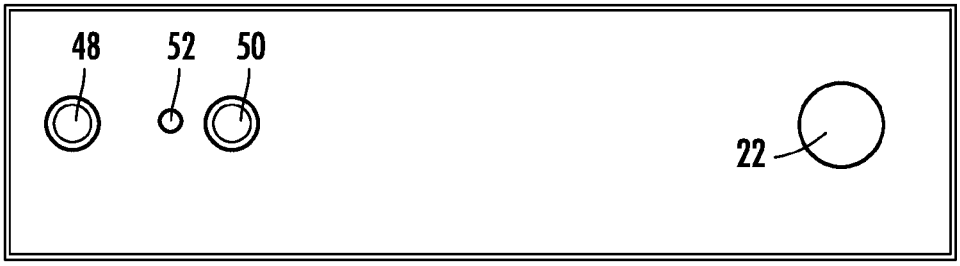
FIGS. 11A-11B are schematic views of the water tank system of the present disclosure at a second stage of the flush function according to an exemplary embodiment.
Figure 11A:
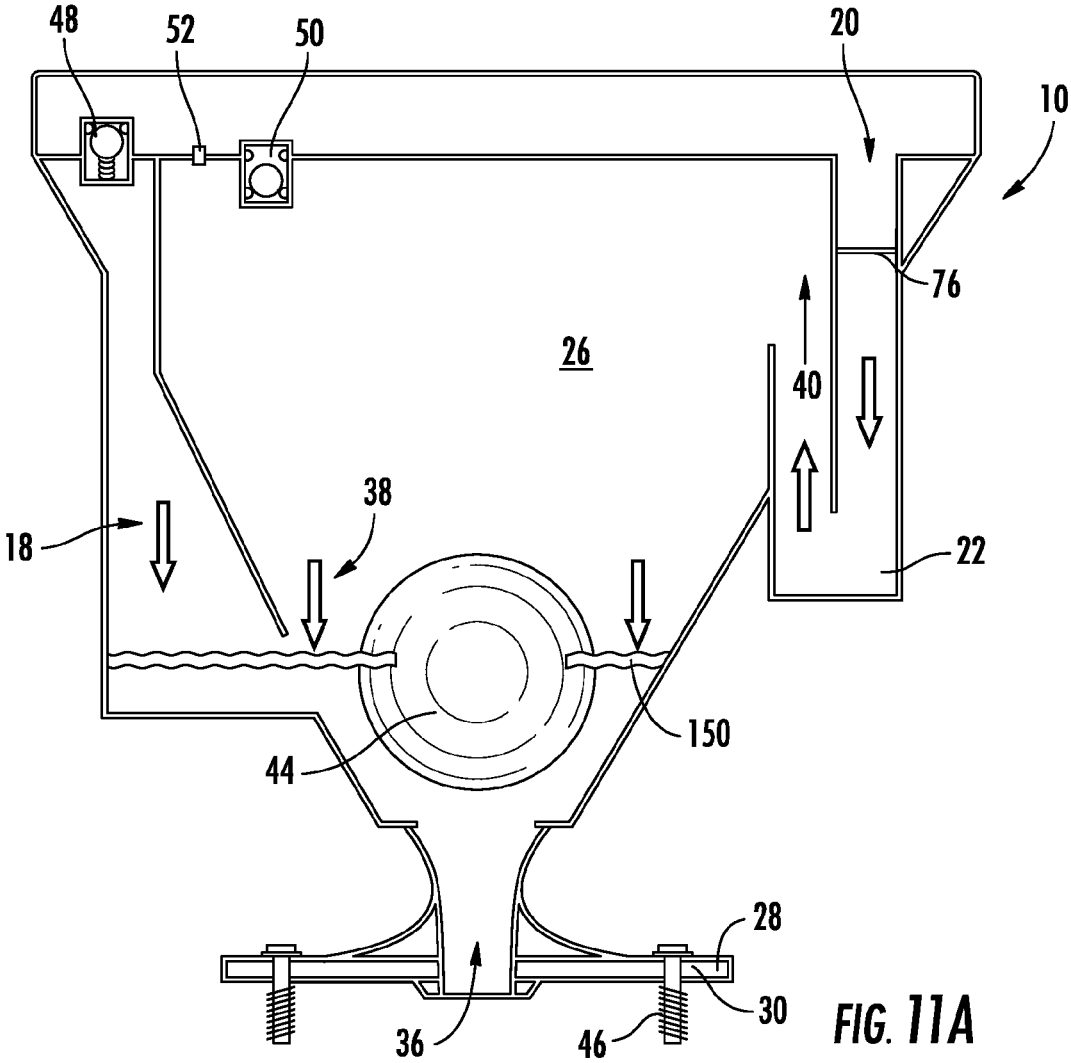

FIGS. 11A and 11B illustrate the multi-chamber tank system at a later stage of the flush function cycle. FIG. 11A shows a front view and FIG. 11B shows a top view of the multi-chamber tank system. At this stage, water continues to exit the flush chamber 26 through the primary orifice 36. The main vent 22 remains open and free of water, allowing air to enter the multi-chamber tank 10 as water exits the multi-chamber tank 10, preventing an additional vacuum pressure from being created within the multi-chamber tank 10. When the water level 150 within the flush chamber 26 lowers below the top of the opening 38, the water within the pressure chamber 18 is no longer held within the pressure chamber 18 by the pressure of the air within the flush chamber 26. Thus, the water within the pressure chamber 18 drains out through the primary orifice 36 under the force of gravity. The pressure chamber 18 then re-fills with air from the outside atmosphere through the main vent 22. As the water exits the multi-chamber tank 10 through the primary orifice 36, the flush ball 44 lowers within the flush chamber 26 toward the primary orifice 36.

Figure 12B:
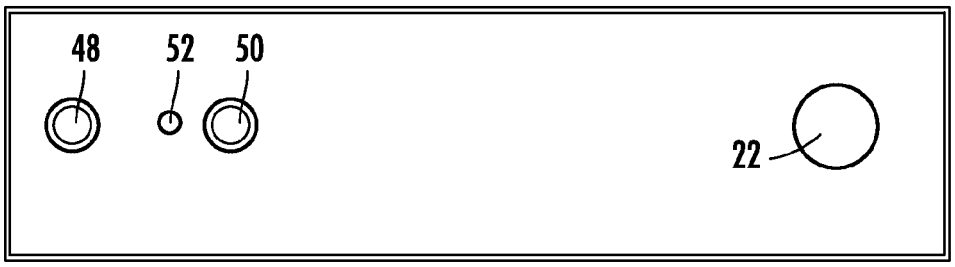
FIGS. 12A-12B are schematic views of the water tank system of the present disclosure at a final stage of the flush function according to an exemplary embodiment.
Figure 12A:
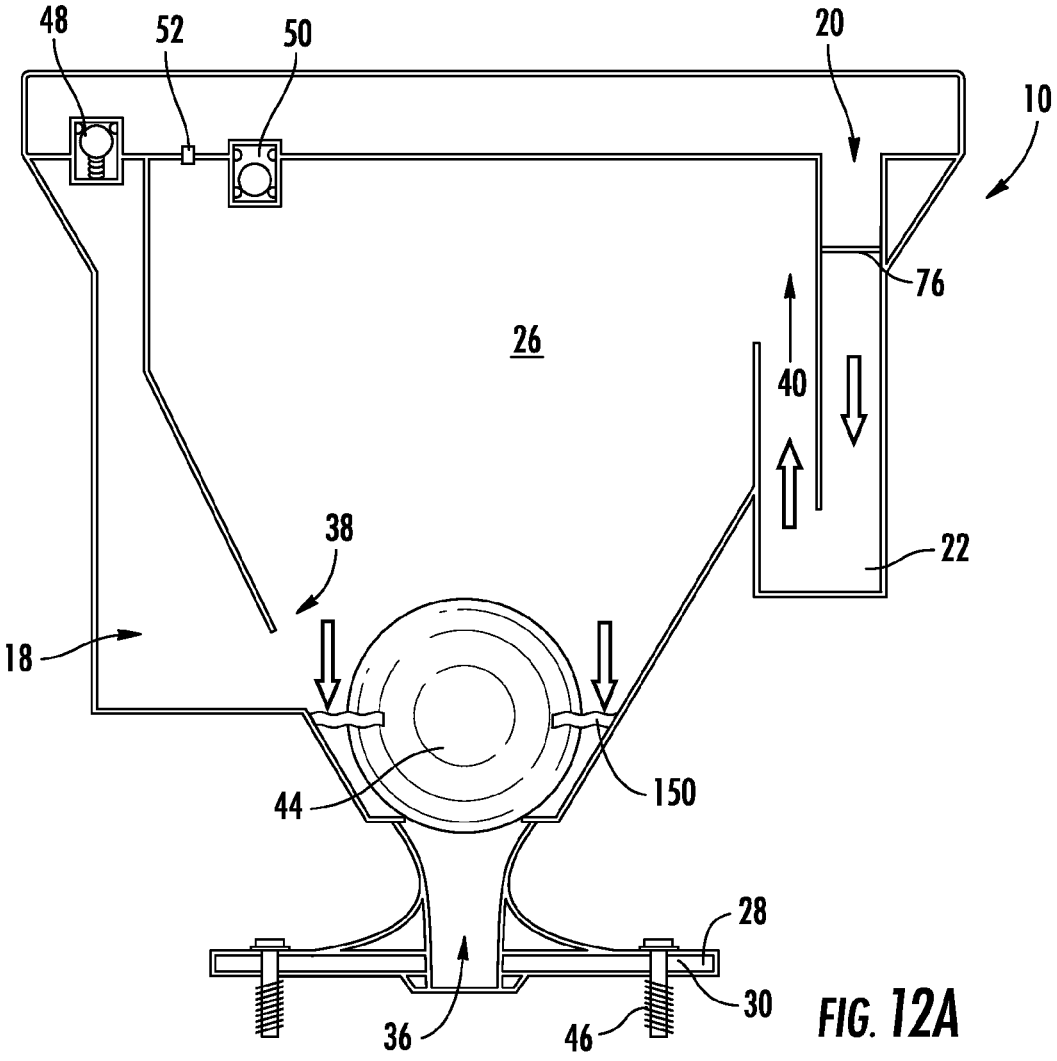

FIGS. 12A and 12B illustrate the multi-chamber tank system at the end of the flush cycle. FIG. 12A shows a front view and FIG. 12B shows a top view of the multi-chamber tank system. At the end of the flush cycle, the flush ball 44 re-seats itself in the primary orifice 36 at the bottom of the flush chamber 26. The multi-chamber tank system may include a fill valve (e.g., a fill valve 88 shown in FIG. 23) connected to a water source and fluidly connected to the multi-chamber tank 10 for re-filling the tank 10 with water. At this stage, the multi-chamber tank 10 is re-filled with water, with water filling the flush chamber 26 around the flush ball 44. The check valve 48 is again closed or non-actuated to allow pressure to build within the pressure chamber 18.

Figure 12C:
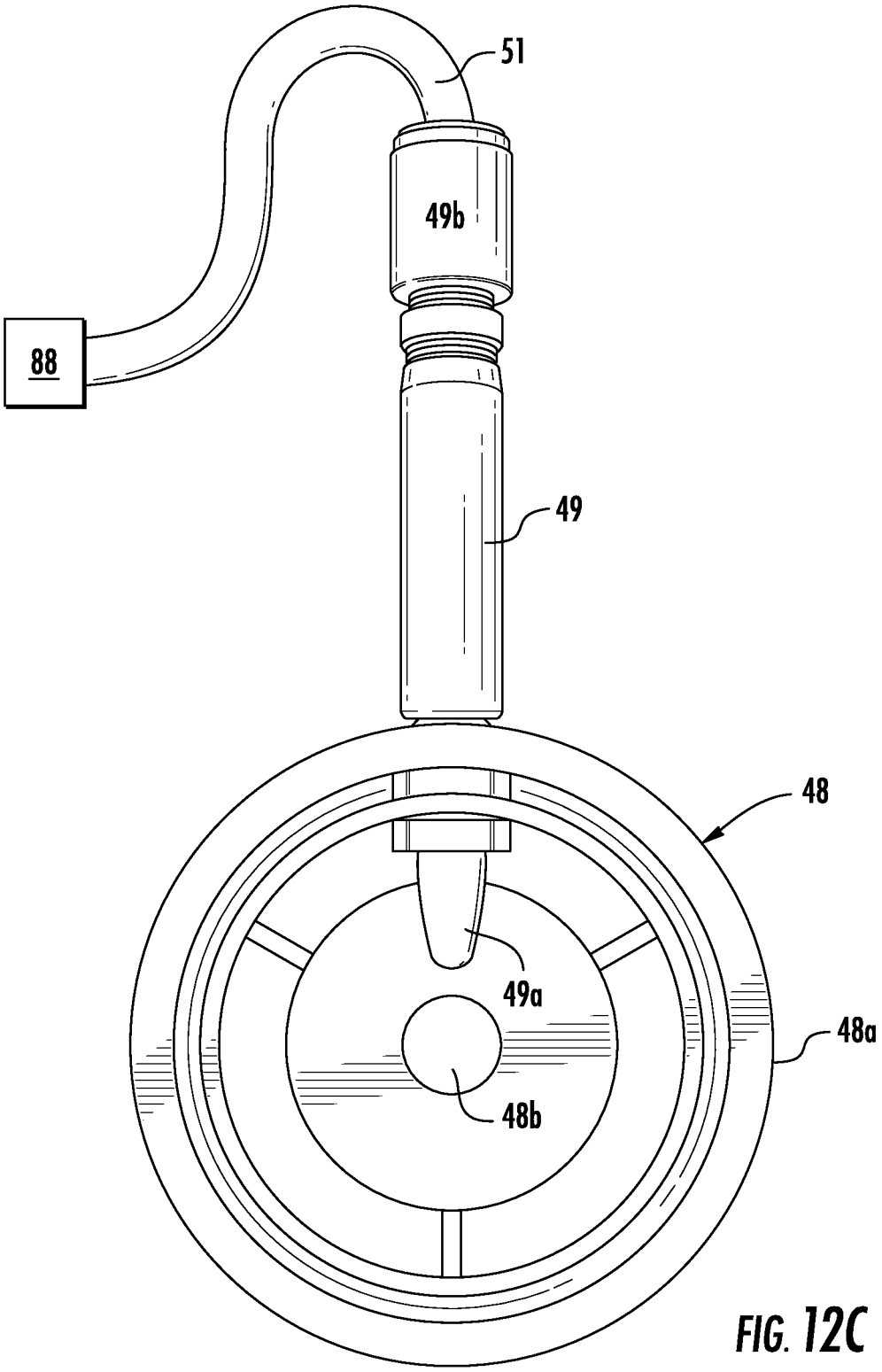
FIGS. 12C-12D are rear views of a check valve for use in a water tank system according to an exemplary embodiment.
Figure 12D:
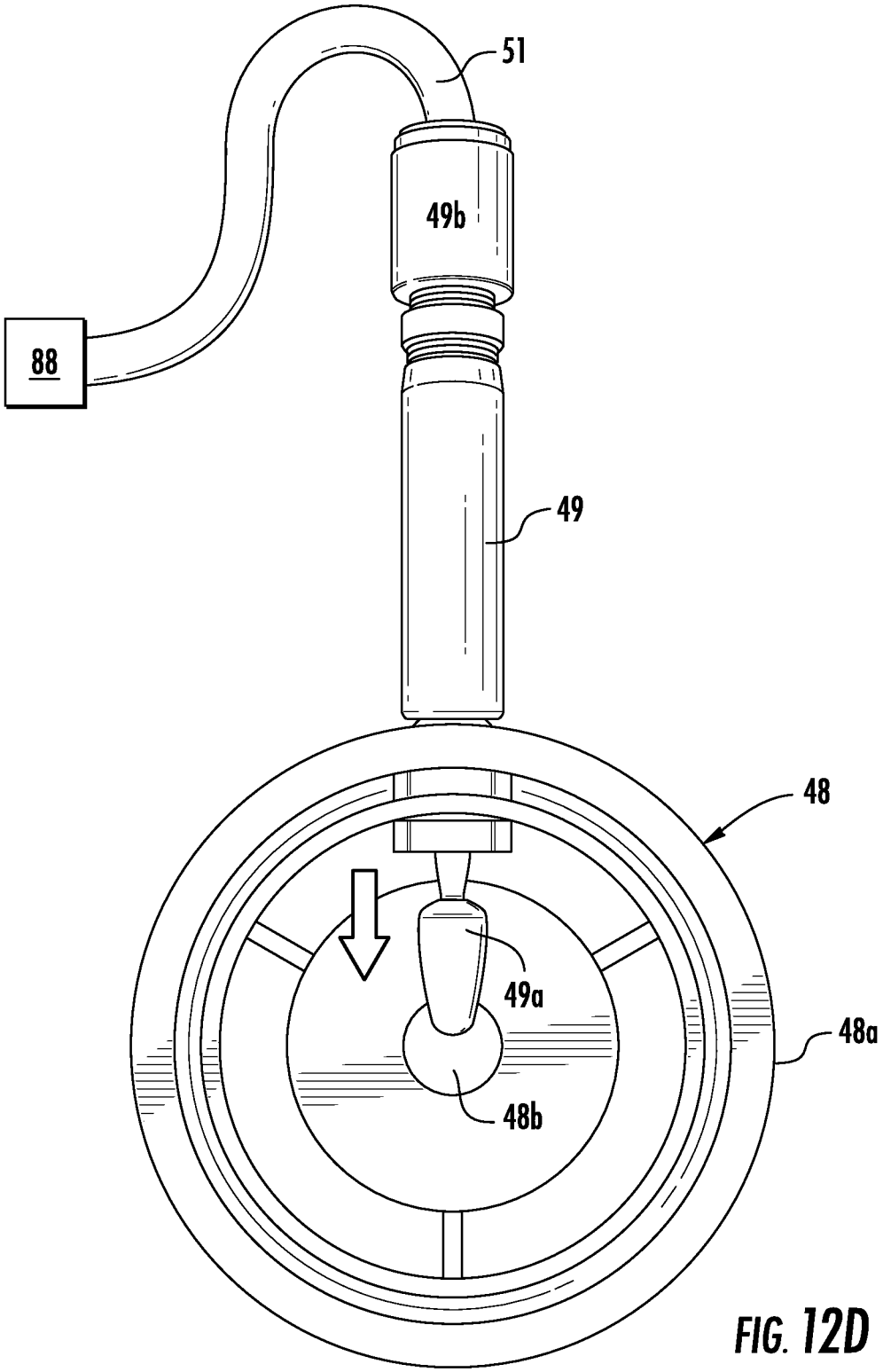

FIGS. 12C-12D illustrate a rear view of the check valve 48 according to an exemplary embodiment. As shown in FIG. 12C, the check valve 48 includes an actuator 49, such as a pneumatic actuator, coupled to the check valve 48. The actuator is configured to automatically prevent actuation of the check valve 48 when the pressure chamber 18 is being pressurized, such as when the multi-chamber tank 10 is being re-filled with water during a flush cycle.

As shown in FIGS. 12C-12D, the actuator 49 is coupled to a sidewall 48*a* of the check valve 48. The actuator 49 includes a proximal end 49*a* and a distal end 49*b*. The proximal end 49*a* protrudes through the sidewall 48*a*, and the distal end 49*b* is coupled to a water line 51 (e.g., hose, conduit, etc.). The actuator 49 is fluidly connected to a fill valve 88 via the water line 51. The actuator 49 is configured to be actuated by way of fluid flowing through the water line 51 when the refill valve 88 is operated, such as when the tank is being re-filled during a flush cycle. When the actuator 49 is actuated (e.g., operated), the proximal end 49*a* is configured to move (e.g., translate, travel, etc.) a distance such that at least a portion of the proximal end 49*a* overlaps at least a portion of the check valve 48 to thereby prevent (e.g., impede, restrict, etc.) actuation of the check valve 48. For example, as shown in FIG. 12C, the proximal end 49*a* of the actuator is shown overlapping a portion of a valve stem 48*b* of the check valve 48, to thereby impede movement of the valve stem 48*b*. In this state, the check valve 48 cannot be actuated by a user due to the position of the proximal end 49*a* relative to the valve stem 48*b*.

By way of example shown in FIG. 12C, the actuator 49 is shown in a first, non-actuated state. In the first state, the check valve 48 is free to be operated (e.g., opened) by a user, such as to initiate a flush cycle (as shown in FIG. 9A). That is, the valve stem 48*b* is free to move unimpeded within the check valve 48 to allow initiation of a flush cycle. After the flush cycle is initiated by the user and the flush chamber 26 has emptied, the refill valve 88 can begin to refill the multi-chamber tank 10 (as shown in FIGS. 10A-14B). A portion of the water flowing from the refill valve 88 may be directed to the actuator via the water line 51 (e.g., via a Y-connector (not shown) or other suitable connector) thereby causing the proximal end 49*a* of the actuator to move (e.g., actuate, translate, travel, etc.) relative to the check valve 48. The flow rate of the water flowing to the actuator 49 is sufficient to move (e.g., actuate, etc.) the proximal end 49*a* to a position relative to the check valve 48 that prevents (e.g., impedes, restricts, etc.) the valve stem 48*b* from being opened (e.g., actuated, moved, etc.).

As shown in FIG. 12D, the actuator 49 is shown in a second, actuated state. In the second state, the proximal end 49*a* overlaps at least a portion of the valve stem 48*b* of the check valve 48 such that the check valve 48 cannot be actuated (e.g., opened) by a user. Once refilling of the multi-chamber tank 10 is completed (see FIG. 14A), the flow of water to the actuator 49 ceases and the proximal end 49*a* can return to the first, non-actuated state, thereby enabling actuation of the check valve 48 by a user. In this manner, the actuator 49 prevents inadvertent actuation of the check valve 48 when the multi-chamber tank 10 is being re-filled. This is particularly advantageous in that the actuator 49 prevents the pressure chamber 18 from being inadvertently de-pressurized by a user during re-filling. By allowing the pressure chamber 18 to properly pressurize, the water tank system can perform subsequent flush cycles.

Figure 13B:
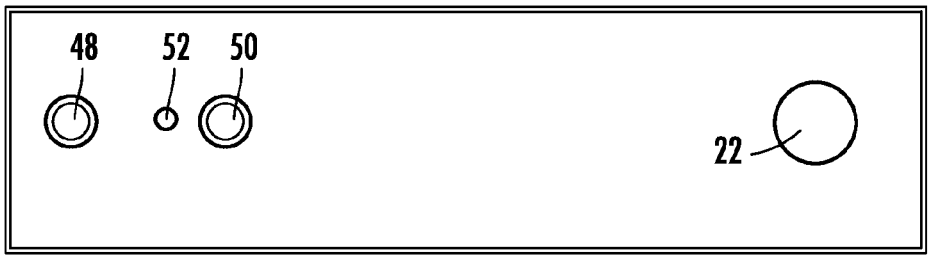
FIGS. 13A-13B are schematic views of the water tank system of the present disclosure after the flush function has completed and as the multi-chamber tank re-fills with water according to an exemplary embodiment.
Figure 13A:
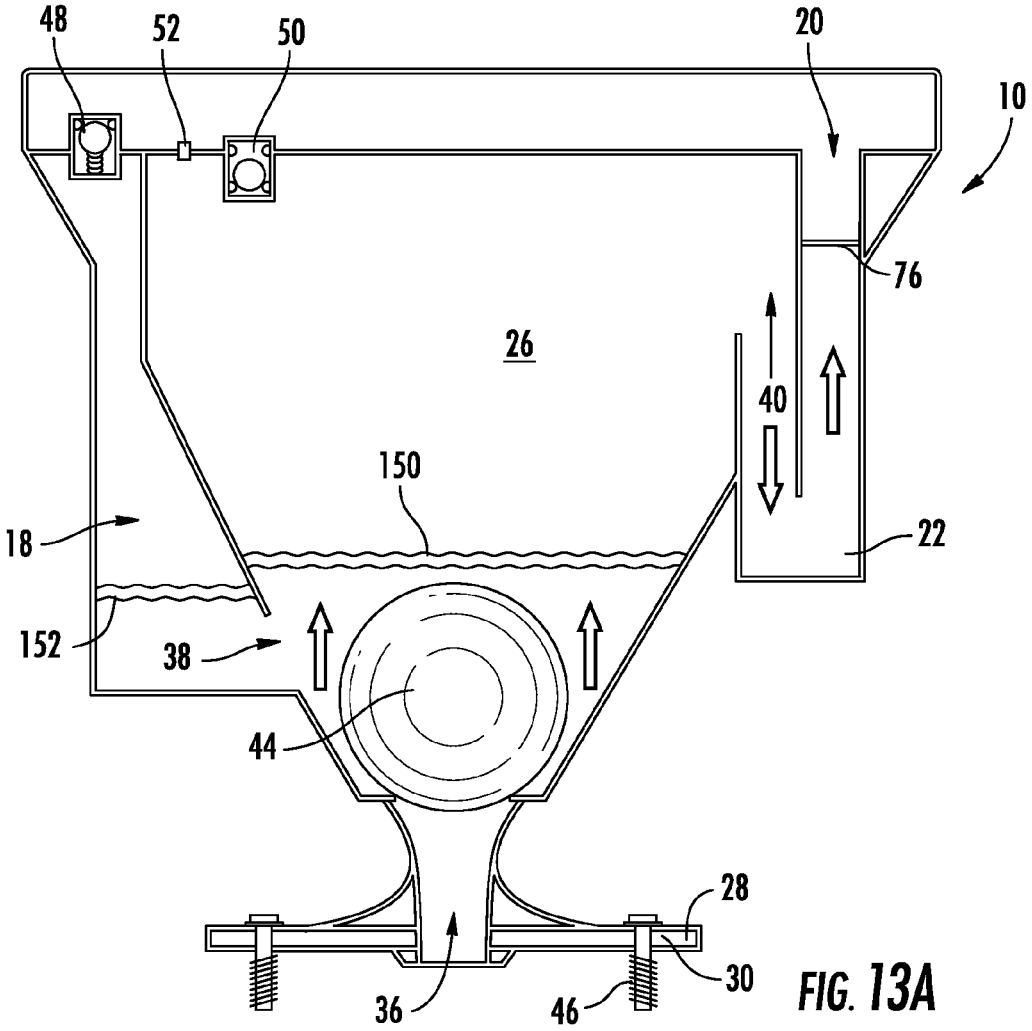

Referring back to the flush cycle, FIGS. 13A and 13B illustrate the multi-chamber tank system as the multi-chamber tank 10 is re-filled with water. FIG. 13A shows a front view and FIG. 13B shows a top view of the multi-chamber tank system. As the water level 150 within the flush chamber 26 rises above the top of the opening 38, pressure begins to build inside the closed pressure chamber 18. The air within the pressure chamber 18 is compressed, as the closed check valve 48 prevents air from escaping the pressure chamber 18. The air within the multi-chamber tank 10 that is displaced by the water leaves the inside of the multi-chamber tank 10 through the main vent 22, so that the pressure within the pressure chamber 18 is greater than the pressure within the air space of the flush chamber 26. The water fills the multi-chamber tank 10, raising the water level within the flush chamber 26 above the opening 40.

Figure 14B:
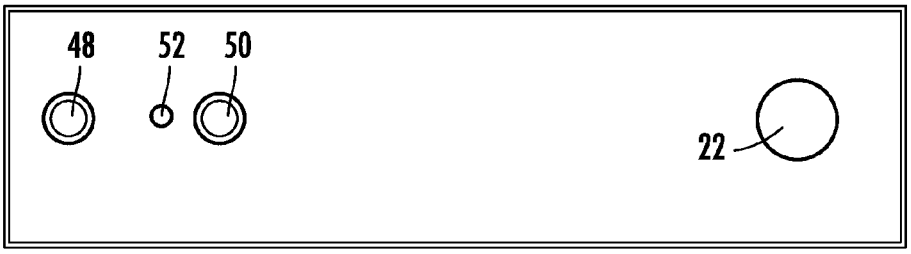
FIGS. 14A-14B are schematic views of the water tank system of the present disclosure after the multi-chamber tank has been re-filled with water according to an exemplary embodiment.
Figure 14A:
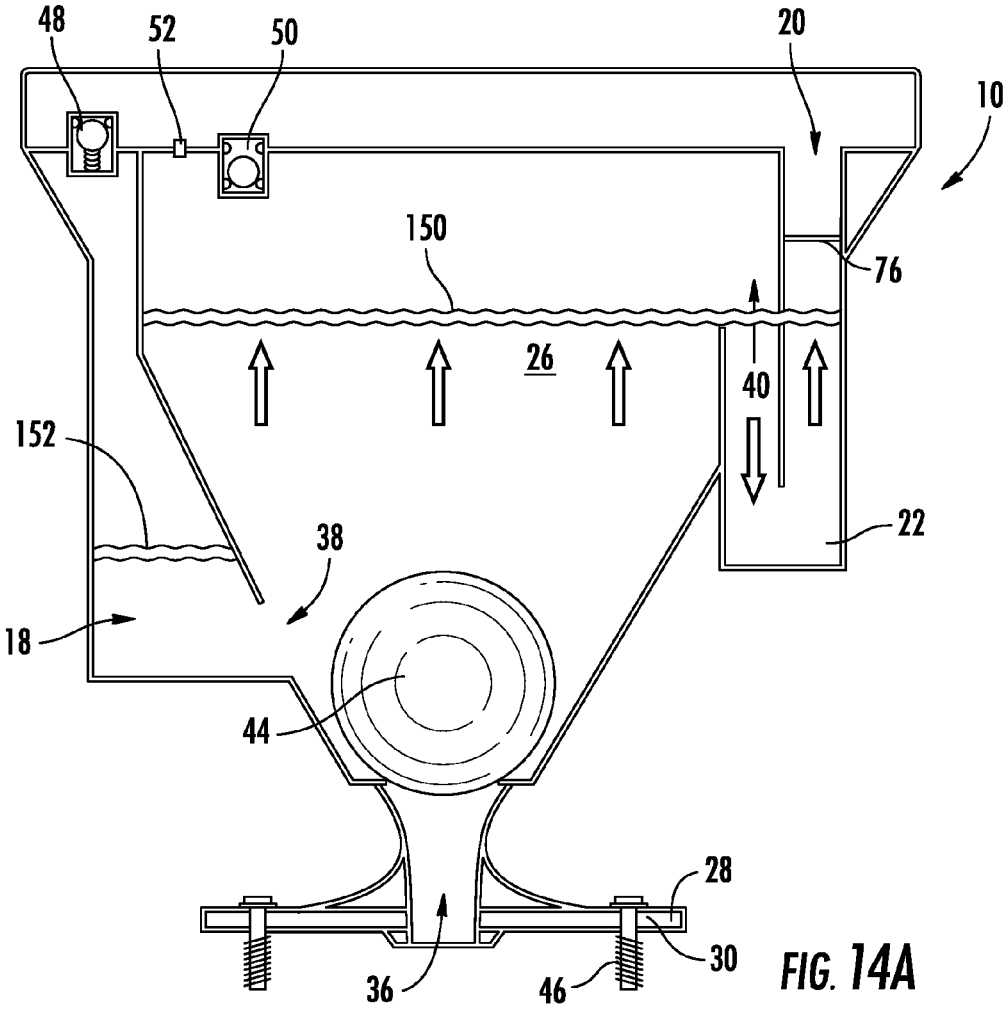

FIGS. 14A and 14B show the multi-chamber tank system once the multi-chamber tank 10 has been re-filled with water. FIG. 14A shows a front view and FIG. 14B shows a top view of the multi-chamber tank system. As the water level within the flush chamber 26 rises above the opening 40, the water flows into the main vent 22, re-sealing the flush chamber 26 from the air of the outside atmosphere. Once the multi-chamber tank 10 is thus effectively re-sealed, the additional water filling the flush chamber 26 above the height of the opening 40 displaces air that can no longer exit the multi-chamber tank 10 through the main vent 22. The displaced air then exits the multi-chamber tank 10 through the check valve 50. At this point, the air pressure inside the flush chamber 26 is approximately equal to the air pressure outside of the multi-chamber tank 10, and the multi-chamber tank system is reset for the next flush (i.e., it is back to the "rest" position described with respect to FIGS. 8A and 8B).

Figure 15:
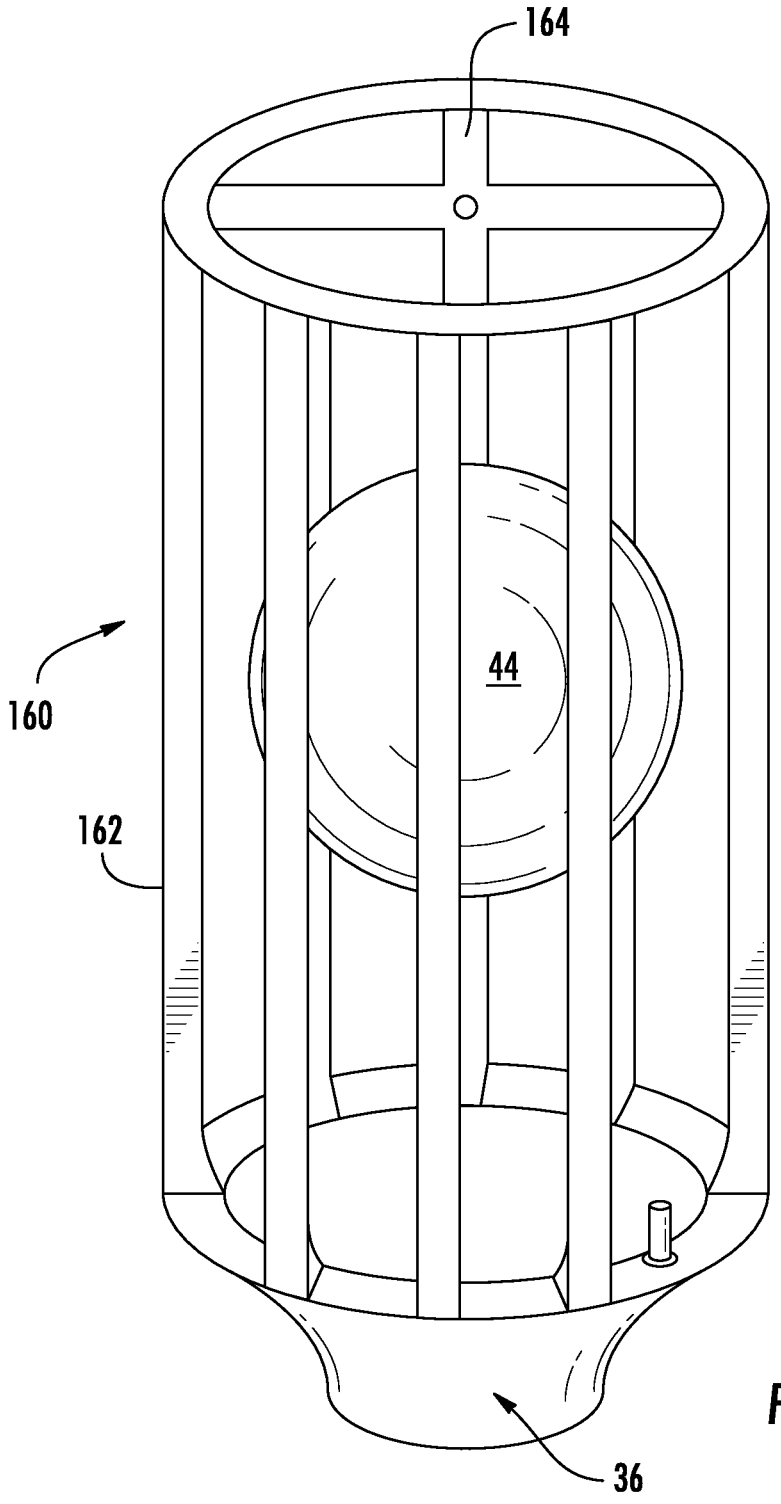
FIG. 15 is a perspective view of a cage for the flush ball according to an exemplary embodiment.

Referring now to FIG. 15, a cage 160 for the flush ball 44 is shown according to an exemplary embodiment. The cage 160 may optionally be used in conjunction with the various embodiments discussed herein, and is intended to protect the flush ball 44 and to guide the movement of the flush ball 44 in a single vertical direction. The cage 160 includes guides 162 for preventing the flush ball 44 from moving laterally and a stop 164 at the top of the cage 160 for preventing the flush ball 44 from moving past a predetermined vertical height (i.e., the height of the stop 164) within the flush chamber 26. The stop 164 includes openings 166 for allowing water and air to pass through the cage 160. The cage 160 may be positioned within the flush chamber 26 so that the cage 160 is coaxial with the primary orifice 36, with the bottom of the cage 160 being open and configured to mate with the primary orifice 36. The cage 160 may be sized and shaped to fit the primary orifice in exemplary embodiments. The height of the cage 160 may be set at any desired level to effectively control the volume of water released by the tank.

Referring now to FIGS. 16-19, a multi-chamber tank 60 is shown according to another embodiment of the multi-chamber tank system. The multi-chamber tank 60 includes an orifice 184 fluidly connecting the multi-chamber tank 60 to a toilet bowl 66. A flush ball 72 covers the orifice 184, forming a fluid seal to selectively prevent water from flowing into the toilet bowl 66 from the multi-chamber tank 60. In one embodiment, the flush ball 72 is a rubber ball configured to create a fluid seal with a plastic surface surrounding the orifice 184. In another embodiment, the flush ball 72 is a hard ball that creates a fluid seal with a gasket (not shown) positioned at the orifice 184.

Figure 18:
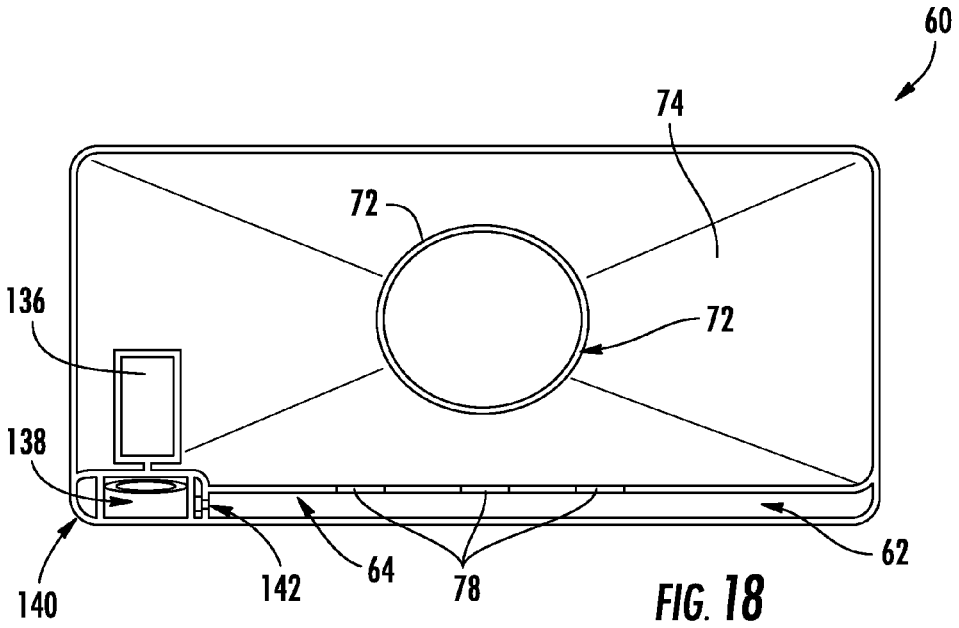
FIG. 18 is a schematic top view of the multi-chamber tank of FIG. 16.
Figure 19:
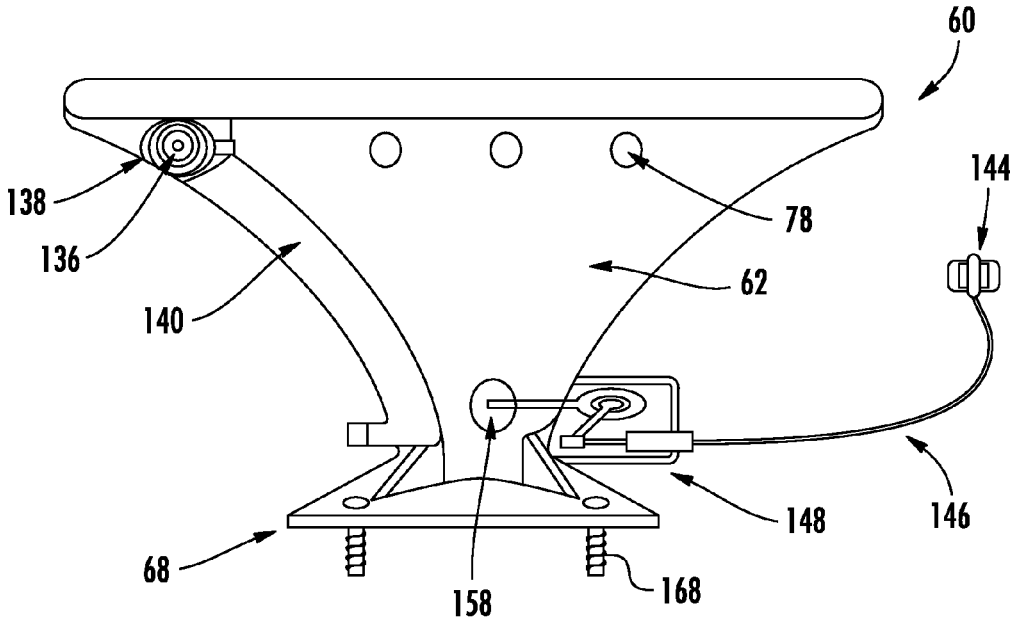
FIG. 19 is a schematic side view of the multi-chamber tank of FIG. 16.

In the illustrated embodiment of FIGS. 18 and 19, the flush ball 72 may be mechanically lifted away from the orifice 184 in order to perform the flush function of the multi-chamber tank system. The multi-chamber tank 60 includes an integrated ball actuator 148 configured to actuate or trigger, providing a force sufficient to cause a lever 158 to lift the flush ball 72 away from the orifice 184. The ball actuator 148 is coupled to a push button 144 or lever by a cable 146 such that when the push button 144 is pressed, the cable 146 causes the ball actuator 148 to actuate or trigger in order to lift the flush ball 72 away from the orifice 184. In other embodiments, the multi-chamber tank 60 may include another type of lever or other device to lift the ball, as may be suitable for the particular application of the multi-chamber tank 60.

The multi-chamber tank 60 includes a flush chamber 74 that is connected to an integrated overflow chamber 62 having a top opening 64. The overflow chamber 62 is positioned at a front side of the multi-chamber tank 60 in this embodiment, but the overflow chamber 62 may be otherwise positioned within the multi-chamber tank 60 in other embodiments, as may be suitable for the particular application of the multi-chamber tank 60 and/or the multi-chamber tank system. In this embodiment, the overflow chamber 62 includes a plurality of holes 78 fluidly connecting the overflow chamber 62 to the flush chamber 74. When the water level within the flush chamber 74 rises to the level of the holes 78, water from the flush chamber 74 flows into the overflow chamber 62. The multi-chamber tank 60 is filled with water by an integrated fill valve 138. A fill valve float 136 rests within the flush chamber 74, signaling to the fill valve 138 to fill the flush chamber 74 with water based on a water level within the flush chamber 74. The flow of water to the flush chamber 74 may be stopped or cut off by a fill valve diaphragm 156. The multi-chamber tank 60 also includes a fill valve supply chamber 140 fluidly connected to the overflow chamber by a refill passage 142.

According to the illustrated embodiment of FIGS. 16-19, the multi-chamber tank 60 also includes a base 68 for connecting to the toilet bowl 66 by fasteners 168 attached through slots 70 of the base 68. The multi-chamber tank 60 is similar in shape and function to the multi-chamber tank 10, being shaped to increase the velocity of the water flow within the multi-chamber tank 60. In the illustrated embodiment of FIG. 19, the multi-chamber tank 60 has a funneled shape to direct water within the multi-chamber tank 60 toward the orifice 158, increasing the velocity of the water flow through the multi-chamber tank 60. In other embodiments, the multi-chamber tank 60 may be otherwise shaped, as may be suitable for the particular application of the multi-chamber tank 60 and/or the multi-chamber tank system.

Figure 20:
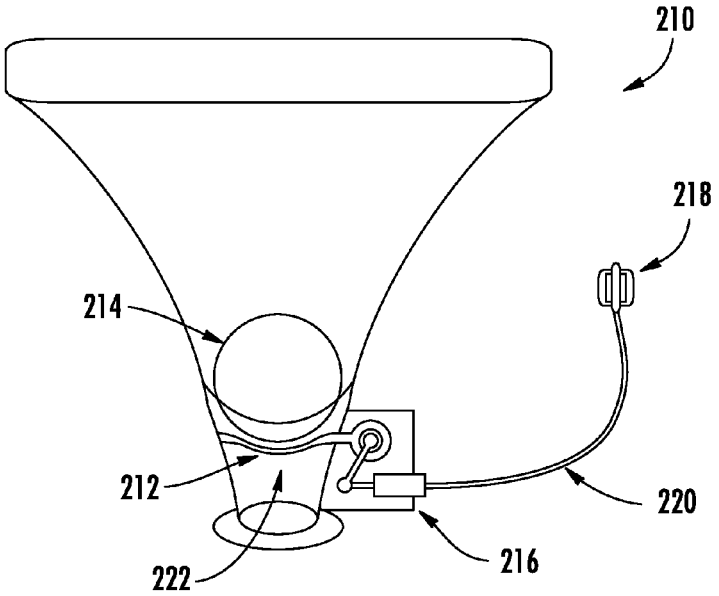
FIG. 20 is a perspective view of a tank for the water tank system with a free-floating flush ball according to an exemplary embodiment.

Referring now to FIG. 20, a tank 210 is shown for the multi-chamber tank system according to an exemplary embodiment. In this embodiment, the tank 210 includes a buoyant flush ball 214 forming a fluid seal over an orifice 222. The orifice 222 may be configured to provide a fluid connection between the tank 210 and a toilet bowl when the flush ball 214 is pushed away from the orifice 222 to break the fluid seal. In this embodiment, a ball actuator 216 similar to the ball actuator 148 is configured to actuate or trigger, providing a force sufficient to cause a lever 212 (similar to lever 158) to lift the flush ball 214 away from the orifice 222. The ball actuator 216 is coupled to a push button 218 (similar to push button 144) or another type of actuator by a cable 220, such that when the push button 218 is pressed or otherwise actuated, the cable 220 causes the ball actuator 216 to actuate or trigger in order to lift the flush ball 214 away from the orifice 222. The tank 210 has a funneled shape in order to "funnel," or force, water within the tank 210 toward the orifice 222 when the flush ball 214 is lifted, and to return the flush ball 214 to the orifice 222 (i.e. the sealing surface) without a chain, tether, or any other types of guides at the completion of the flush function or cycle.

Figure 21:
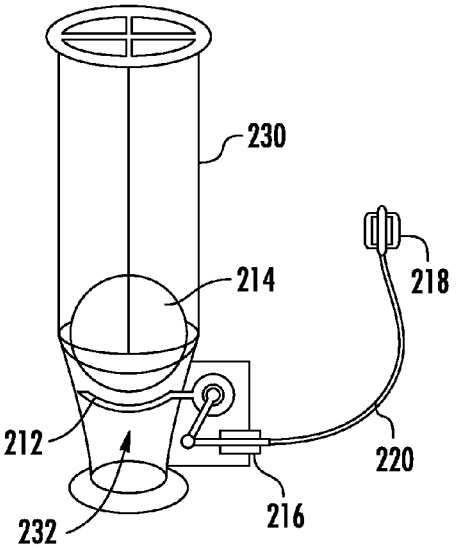
FIG. 21 is a perspective view of a cage for a flush ball according to an exemplary embodiment.
Figure 22:
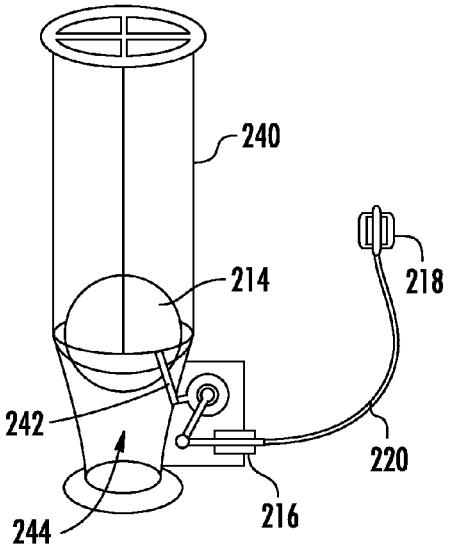
FIG. 22 is a perspective view of another cage for a flush ball according to an exemplary embodiment.

Referring now to FIGS. 21 and 22, cage 230 and cage 240 are shown for the multi-chamber tank system according to exemplary embodiments. The cages 230 and 240 may be used in conjunction with any of the tanks described within this disclosure, including the multi-chamber tank 10, the multi-chamber tank 60, and those described below. The cages 230 and 240 are configured to protect and guide the flush ball 214 during all stages of the flush function, or cycle, of the multi-chamber tank system. The cages 230 and 240 may also be used with any other flush balls described within this disclosure. In the illustrated embodiment of FIG. 21, the cage 230 includes the lever 212. The lever 212 is configured to dislodge the flush ball 214 from an orifice 232 of the cage 230, such as to fluidly connect the cage 230 (and an associated tank) to a toilet bowl. In the illustrated embodiment of FIG. 22, the cage 240 includes a pin 242 instead of the lever 212. The pin 242 is shorter and smaller than the lever 212, but has a similar function. The pin 242 is configured to dislodge the flush ball 214 from an orifice 244 of the cage 240, such as to fluidly connect the cage 240 (and an associated tank) to a toilet bowl. In these embodiments, the lever 212 and the pin 242 are moved by the ball actuator 216, which is triggered or actuated by the push button 218.

Figure 23:
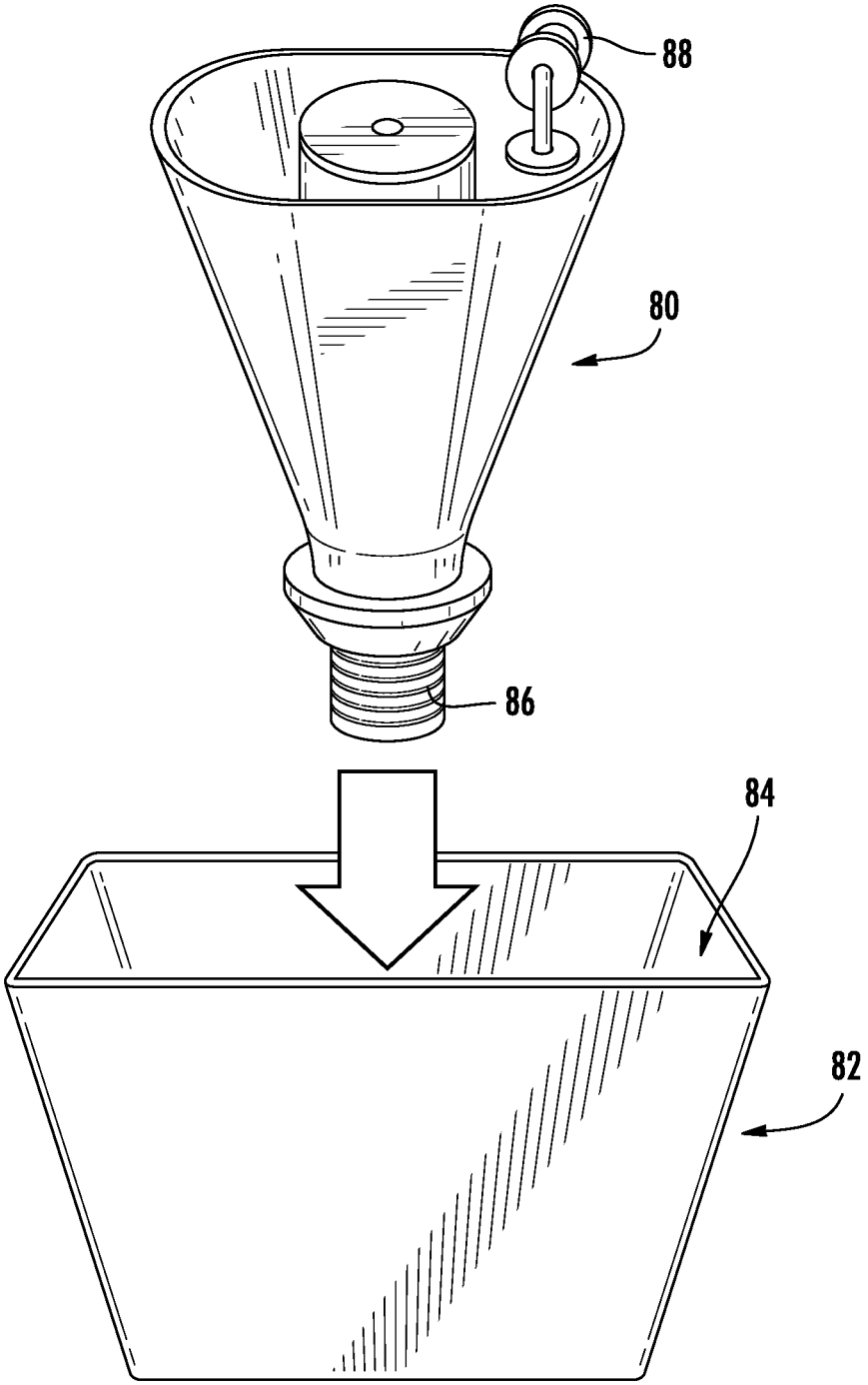
FIG. 23 is an exploded perspective view of a water tank system for a toilet according to an exemplary embodiment.

Referring now to FIG. 23, a tank 80 for the multi-chamber tank system is shown according to an exemplary embodiment. In this embodiment, the tank 80 includes a fill valve 88 connected to a water source for filling the tank 80 with water. The fill valve 88 may be connected to the water source by a feed tube and/or a flex hose connection (not shown). The tank 80 may include connecting threads 86 for coupling the tank 80 to a toilet bowl such as toilet bowl 66. In this embodiment, the tank system includes a shroud 82 (i.e., tank) for covering the tank 80. The tank 80 is inserted into the shroud 82 through an opening 84 within the shroud 82, mounting the tank 80 with a tank shown as shroud 82.

Figure 24:
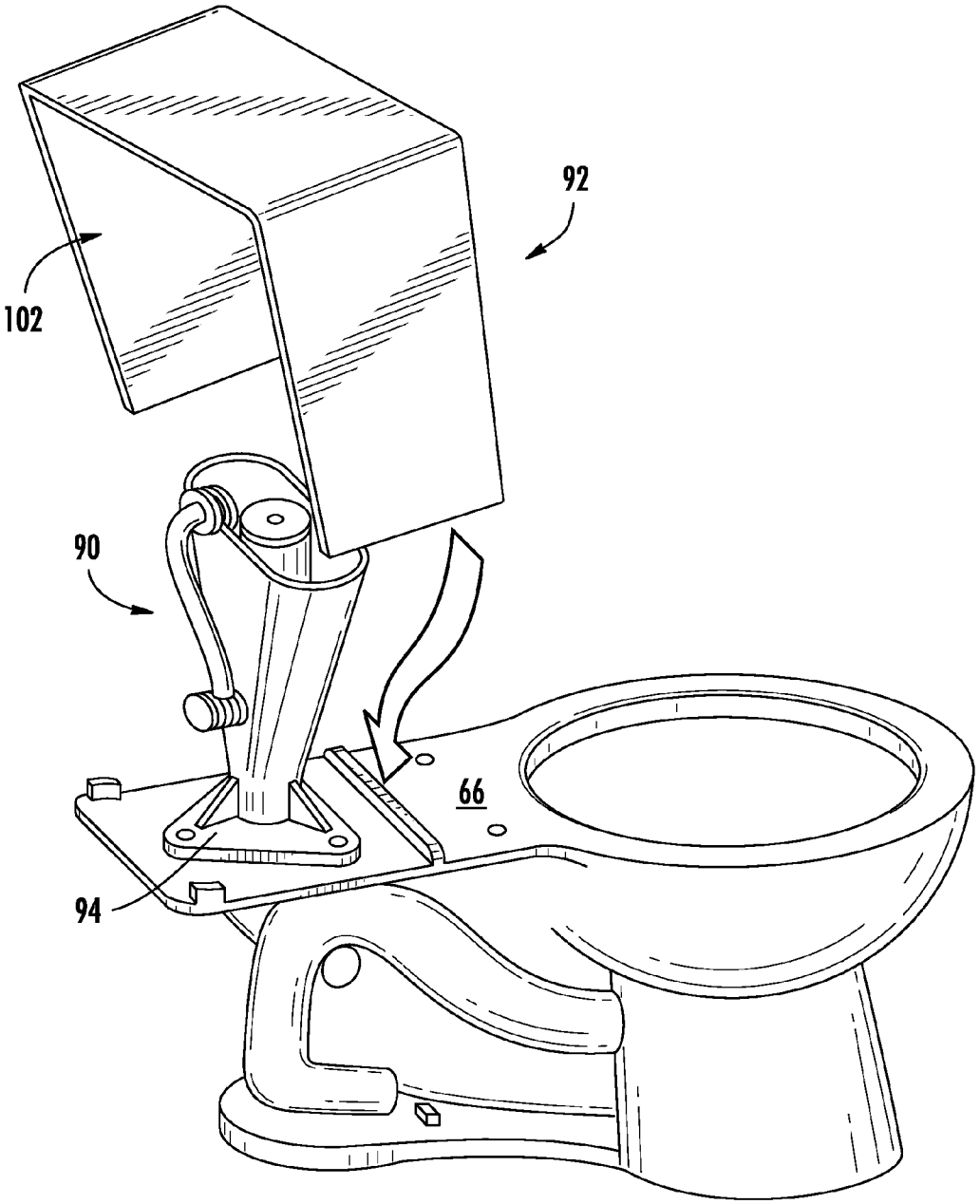
FIG. 24 is an exploded perspective view of a toilet that includes a water tank system having an open-bottom and open-back shroud according to an exemplary embodiment.

Referring now to FIG. 24, a tank 90 for the multi-chamber tank system is shown according to an exemplary embodiment. In this embodiment, the tank 90 is connected to the toilet bowl 66 by a base 94. Once coupled or connected to the toilet bowl 66, a shroud 92 is placed over the tank 90 to conceal the tank 90. The shroud 92 has an open back 102 for servicing and/or interfacing with the tank 90. The shroud 92 may have relatively thin walls so that the shroud 92 is lightweight and can be easily removed and replaced. The shroud 92 and toilet bowl 66 may include components configured to mate with each other in order to install the shroud 92 to the toilet bowl 66.

Figure 25:
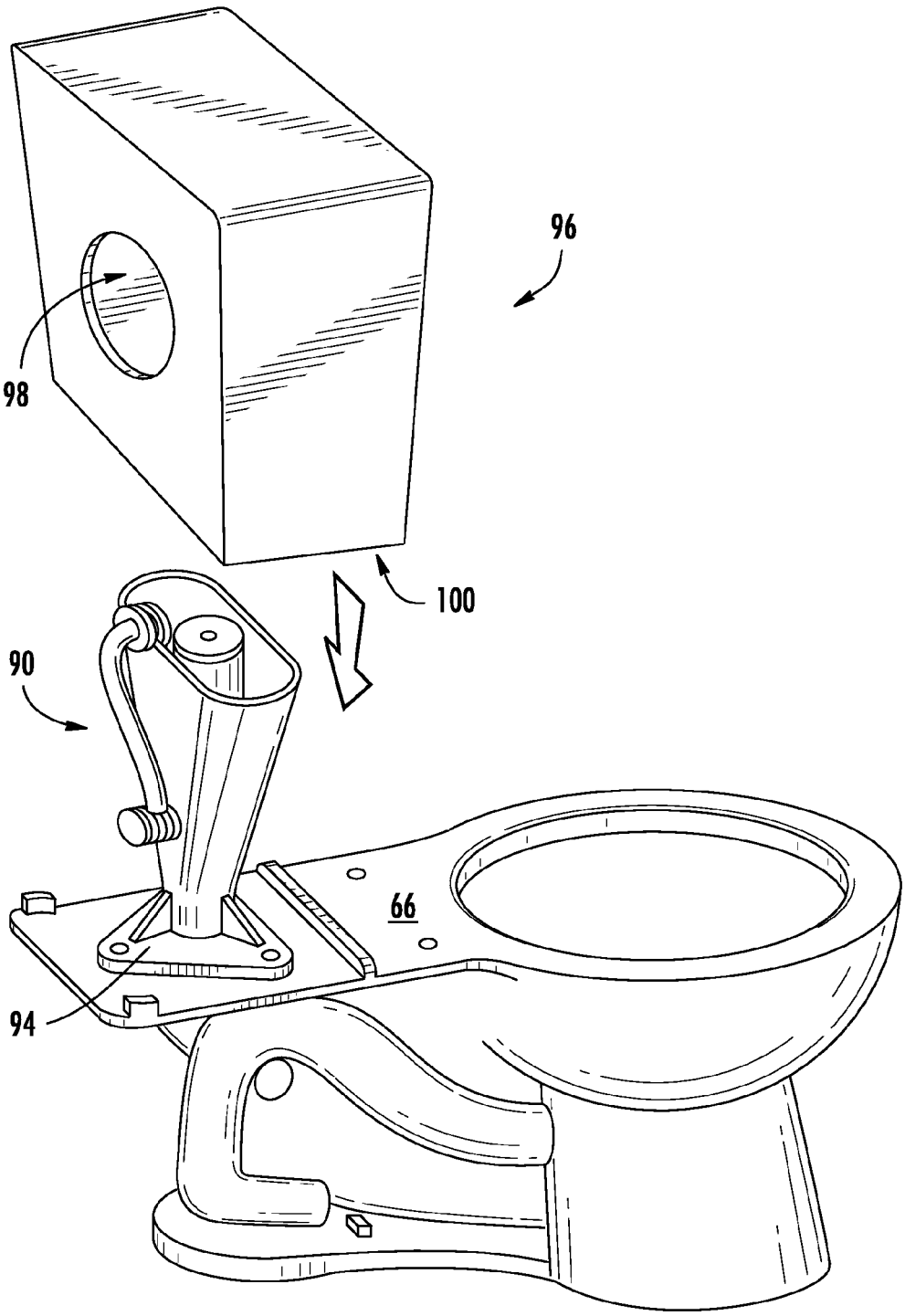
FIG. 25 is an exploded perspective view of a toilet that includes a water tank system having an open-bottom cube cover with an access hole according to an exemplary embodiment.

Referring now to FIG. 25, a cube cover 96 for covering the tank 90 is shown according to an exemplary embodiment. In this embodiment, the cube cover 96 includes an access hole 98 for accessing the tank 90 to service or otherwise interface with the tank 90. The cube cover 96 also includes an open bottom 100 for receiving the tank 90, such that the cube cover 96 may be placed over the tank 90. The cube cover 96 and the toilet bowl 66 may include one or more components or features configured to mate with each other (e.g., tabs, latches, connectors, etc.), coupling the cube cover 96 to the toilet bowl 66.

Figure 26:
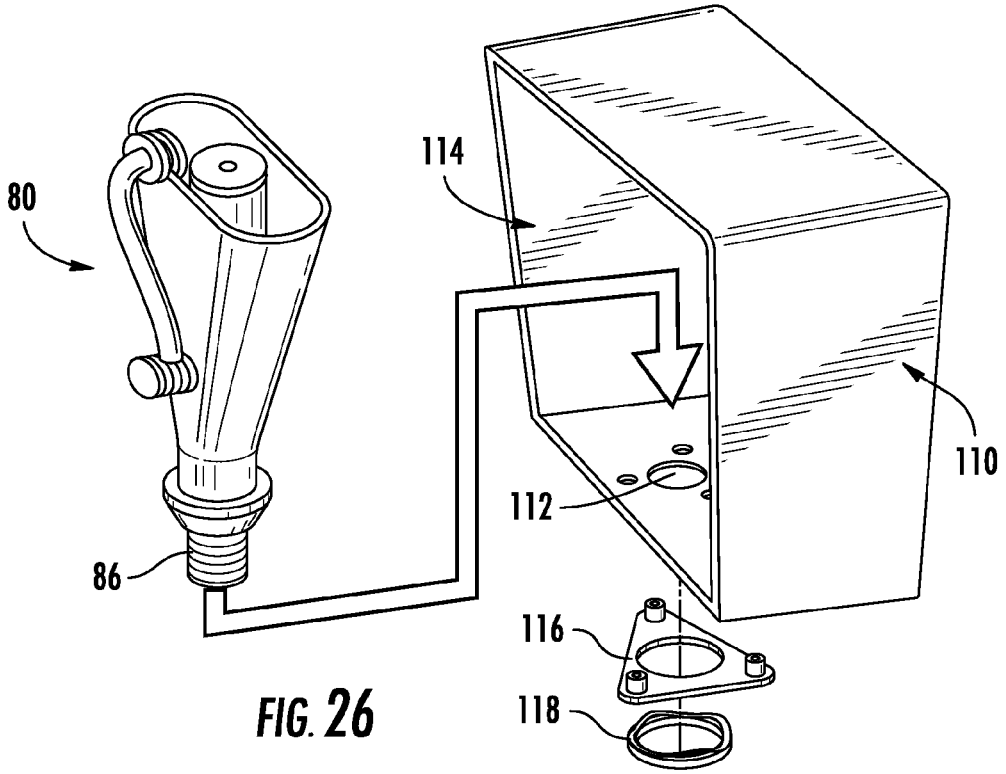
FIG. 26 is an exploded perspective view of a water tank system having an open-back cover according to an exemplary embodiment.

Referring now to FIG. 26, a shroud 110 (i.e., tank) for the tank 80 is shown according to an exemplary embodiment. In this embodiment, the shroud 110 is substantially rectangular and has an open back 114 for receiving the tank 80. The open back 114 may be sized and shaped so that the tank 80 may be serviced. The shroud 110 also includes an opening 112 for receiving the connecting threads 86 of the tank 80. The connecting threads 86 fit through the opening to engage with threads 118 in order to secure the tank 80 to the shroud 110. In this embodiment, the multi-chamber tank system also includes a gasket shown as gasket 116 that is positioned between the shroud 110 and the threads 118. The gasket 116 may be made from a soft foam and intended to provide a fluid seal between the tank 80 and a toilet bowl such as toilet bowl 66.

Figure 27:
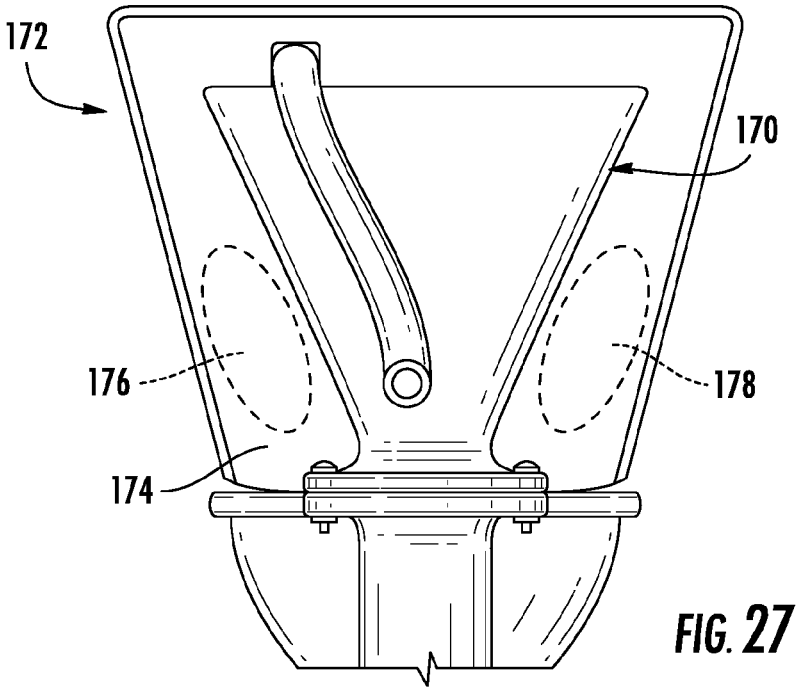
FIG. 27 is a back plan view of a water tank system having an open-back cover according to an exemplary embodiment.

Referring now to FIG. 27, a water tank 170 is shown within an external tank 172 having an open back 174. The water tank 170 has a funnel or V-shape, so that empty spaces 176 and 178 are created within an external tank having a wider shape, such as external tank 172. Accessories for the water tank 170 or the multi-chamber water tank system may be positioned within the empty spaces 176 and/or 178 for enhancing the effectiveness of the water tank 170 and/or another component of the multi-chamber water tank system, or for another purpose suitable for the particular application.

Figure 28A:
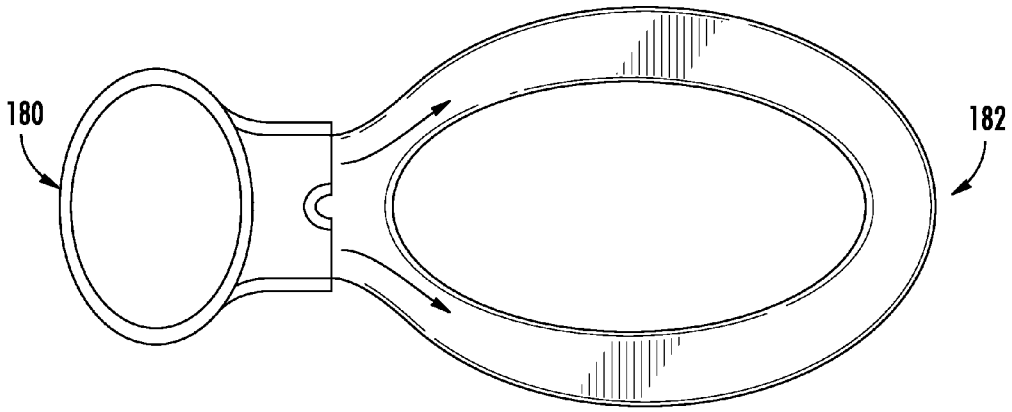
FIG. 28A is a cross-sectional view of a fluid connection between a multi-chamber water tank and a toilet bowl according to an exemplary embodiment.
Figure 28B:
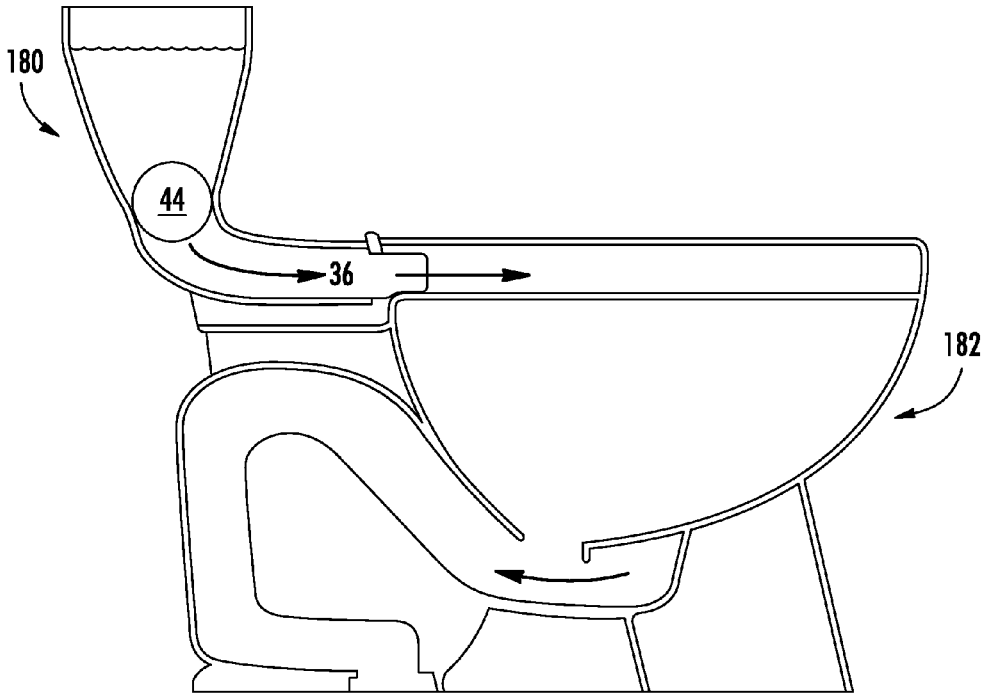
FIG. 28B is another cross-sectional view of the fluid connection between the multi-chamber water tank and the toilet bowl of FIG. 28A.

Referring now to FIGS. 28A-28B, a water tank 180 is shown fluidly connected to a toilet bowl 182 according to an exemplary embodiment. The water tank 180 is configured to drive water through the primary orifice 36 as part of the flush cycle for the toilet. The water may be driven around the inside of the toilet bowl 182, filling the toilet bowl with the clean water from the water tank 180 for use in the next flush cycle. In other embodiments, the water tank 180 or another water tank of the multi-chamber water tank system may be fluidly connected to the toilet bowl 182 or another toilet bowl in another manner suitable for the particular application.

Figure 29:
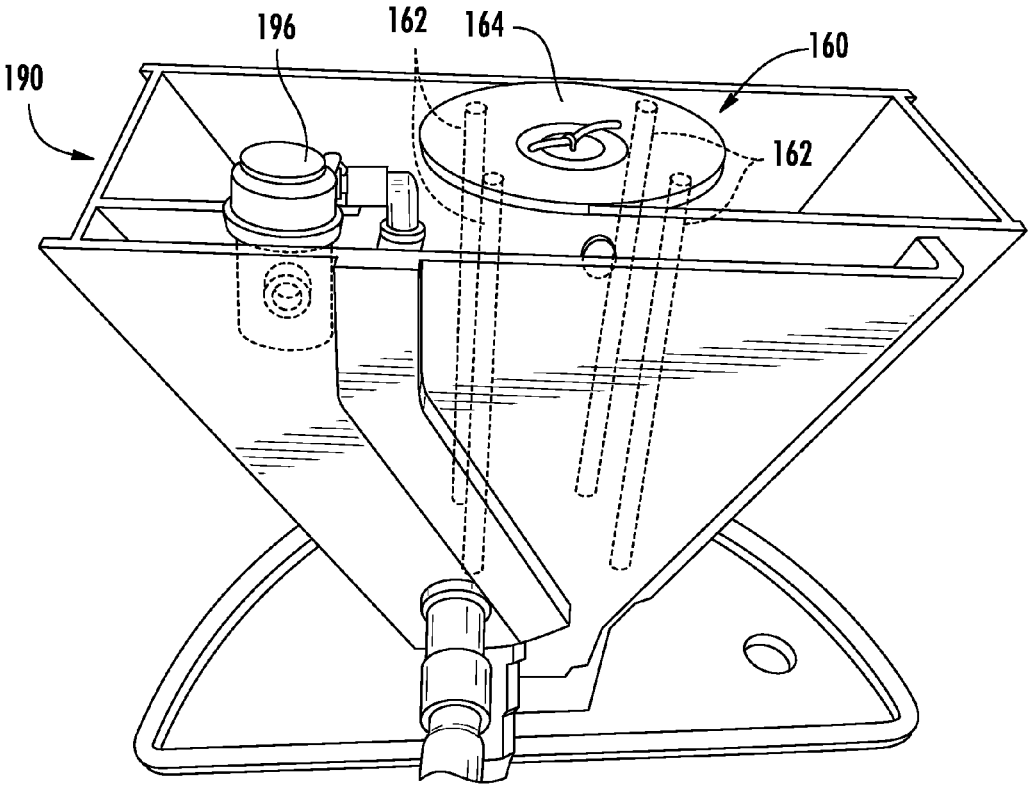
FIG. 29 is a perspective view of a multi-chamber water tank system according to an exemplary embodiment.

Referring now to FIG. 29, the cage 160 is shown as part of a multi-chamber water tank 190 according to an exemplary embodiment. The cage 160 is configured to contain the flush ball 44. The cage 160 limits movement of the flush ball 44 to a single vertical plane. The cage 160 includes guides 162 for preventing movement in the horizontal direction. The stop 164 is positioned at the top of the cage 160 and configured to limit vertical movement past the stop 164. The multi-chamber water tank 190 also includes a fill valve 196 for filling the multi-chamber water tank 190 with water to begin a new flush cycle. In this embodiment, the multi-chamber water tank 190 has a funneled shape intended to increase the velocity of the water flowing through the multi-chamber water tank 190 during a flush cycle. In one embodiment, a water tank system including the multi-chamber water tank 190 produces a water flow during its flush cycle approximately 50 percent greater than the water flow of a similar water system having a square-shaped water tank.

Figure 30:
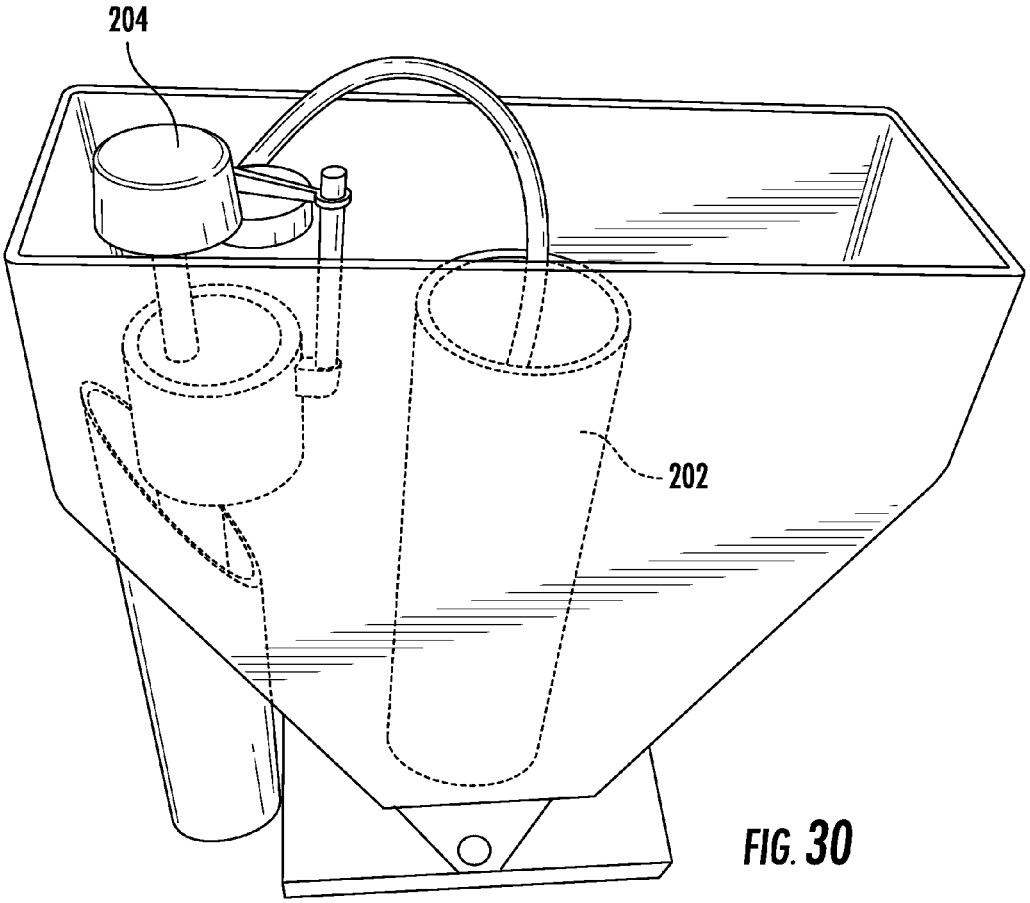
FIG. 30 is a perspective view of a multi-chamber water tank according to an exemplary embodiment.

Referring now to FIG. 30, a water tank 200 is shown according to an exemplary embodiment. The water tank 200 includes a cage 202 fluidly connected to a fill valve 204. The water tank 200 has a funnel or V-shape in order to funnel or direct water toward the bottom of the water tank 200. The cage 202 may be configured to hold a flush ball or other buoyant object for use with the multi-chamber tank system.

Figure 31:
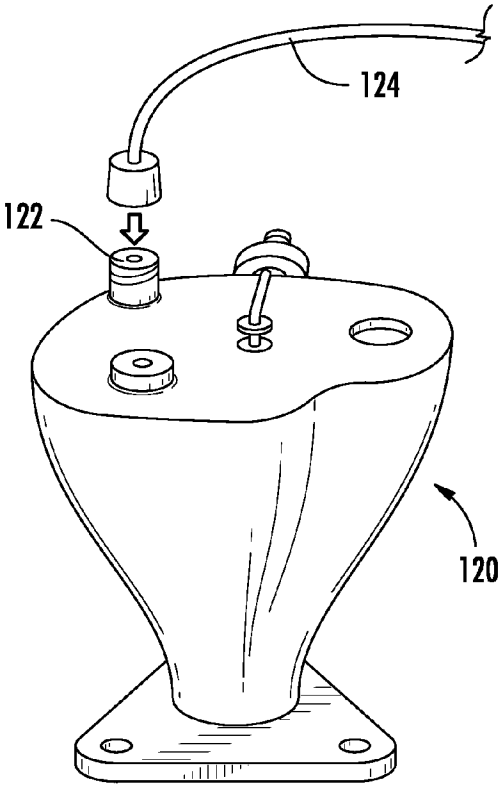
FIG. 31 is an illustration of a flush actuator for the water tank system of the present disclosure according to an exemplary embodiment.

Referring now to FIG. 31, a tank 120 is shown for the multi-chamber tank system. According to an exemplary embodiment, the tank 120 includes a check valve button 122 for actuating the check valve 48. The tank 120 also includes a cable 124 for connecting the check valve button 122 to a check valve actuator (such as those shown in FIG. 32). The check valve button 122 may be pressed or actuated by an operator interfacing the check valve actuator. In an exemplary embodiment, the flush function of the multi-chamber tank system is actuated by pressing the check valve button 122 (e.g., by a check valve actuator, etc.).

Referring now to FIG. 32, actuation devices are shown for actuating the check valve 48. The actuation devices may be connected to the cable 124 in order to press the check valve button 122, actuating the flush function of the multi-chamber tank system. The trip handle 126 presses the check valve button 122 to actuate the check valve 48 by pressing down the trip handle 126. Soft pad 128 may be mounted to the top of the multi-chamber tank 10 and connected to the check valve button 122 such that pressing the soft pad 128 may actuate the check valve 48. The soft pad 128 may be filled with air and the air pressure within the soft pad 128 may be used to provide the pressure necessary to press the check valve button 122. A foot pedal 130 may be connected to the cable 124 and installed at a base of the toilet bowl 66. The foot pedal 130 is configured so that the foot pedal 130 actuates the check valve 48 by pressing down on the foot pedal 130, such as with a foot. A push button 132 may also be connected to the cable 124 in order to actuate the check valve 48 by pressing the push button 132. The multi-chamber tank system may also include a touchless (e.g., hands-free) actuator 134 connected to the cable 124 and configured to actuate the check valve 48 by swiping an object past a sensor, such as an infrared sensor or a capacitive sensor, of the touchless actuator 134. The multi-chamber tank system may also include another type of actuator for pressing the check valve button 122 and actuating the flush function of the multi-chamber tank system, as is suitable for the particular application of the multi-chamber tank system.

Referring now to FIGS. 33-36, a water tank 310 is shown for the multi-chamber tank system according to another exemplary embodiment. According to other exemplary embodiments, the water tank 310 may be used for a single chamber, open-air tank system. As shown in FIGS. 33-36, the water tank 310 includes a free-floating (e.g., buoyant) member in the form of a flush ball 330 forming a fluid seal over an orifice 312. The orifice 312 may be configured to provide a fluid connection between the water tank 310 and a toilet bowl (not shown) when the flush ball 330 is disengaged (e.g., unseated) from the orifice 312 to break the fluid seal. In this embodiment, a flush ball actuator in the form of a slide member 320 is slidably coupled to the water tank 310 between the orifice 312 and the flush ball 330. The slide member 320 is configured to be manually or automatically actuated by a user to selectively disengage (e.g., displace, unseat, etc.) the flush ball 330 from the orifice 312, and to thereby allow water to exit the water tank 310 unrestricted (e.g., unimpeded, uninterrupted, etc.) by the flush ball 330 during a flush cycle. The flush ball 330 is configured to automatically re-seat (e.g., re-engage) itself over the orifice 312 by following the flow of water flowing out of the water tank 310 during the flush cycle without being connected/coupled to a chain, tether, or any other types of guides. In this manner, the water tank 310 achieves effective and reliable flushing without the use of traditional flapper valves, which can wear prematurely after repeated use and can restrict/impede water flow to the orifice. Furthermore, the water tank 310 does not require the use of guides or other similar elements for directing the flush ball 330 to a seated position over the primary orifice 312.

According to the exemplary embodiment shown in FIGS. 33-36, the slide member 320 includes a first end 321 having an opening 324 (e.g., aperture, hole, etc.) disposed therein. The first end 321 is substantially planar and is oriented substantially parallel to a bottom 313. The opening 324 has a diameter that is less than the diameter of the flush ball 330. The diameter of the opening 324 is larger than a diameter of the orifice 312 to allow the flush ball 330 to engage (e.g., seat, contact, etc.) the orifice 312 when the slide member 320 is disposed between the flush ball 330 and the orifice 312. The opening 324 is further configured to allow fluid to exit the flush chamber 316 when the flush ball 330 is disengaged from the orifice 312. The slide member 320 also includes a second end 322 having a substantially upright orientation. The second end 322 is positioned near a top opening of the water tank 310. The slide member 320 curves (e.g., bends, etc.) upward from the first end 321 along an inner surface of the side wall 317 to the second end 322. The plurality of guide members 311 located along the one or more side walls 317 and bottom 313 of the water tank 310 maintain the position/orientation of the slide member 320 relative to the tank 310, and provide a guide (e.g., channel, etc.) for the slide member 320 to move (e.g., slide, translate, etc.) along/within when actuated.

According to an exemplary embodiment, the slide member 320 is configured to be flexible, such as a flexible strip. According to other exemplary embodiments, the slide member 320 is configured to be non-planar and/or to include rigid portions. According to various exemplary embodiments, the slide member 320 may be made out of various semi-rigid materials or combinations of semi-rigid materials such as plastic, rubber, or other materials suitable for the particular application of the water tank 310.

According to various exemplary embodiments, different actuation methods such as those shown in FIG. 32 and as previously described may be employed in conjunction with the slide member 320 to enable a user to manually and/or automatically perform a flush function. For example, the slide member 320 may be actuated by applying a downward force to the second end 322 (represented by the arrow in FIG. 33) using one or more of the actuation methods previously described with reference to FIG. 32. The downward force is such that the first end 321 moves (e.g., translates, slides, etc.) a sufficient distance along a bottom surface 313 of the water tank 310 to disengage (e.g., unseat, displace, etc.) the flush ball 330 from the orifice 312. One or more of the plurality of guide members 311 are configured to guide the slide member 320 relative to the water tank 310 when the slide member 320 is actuated.

Figure 33:
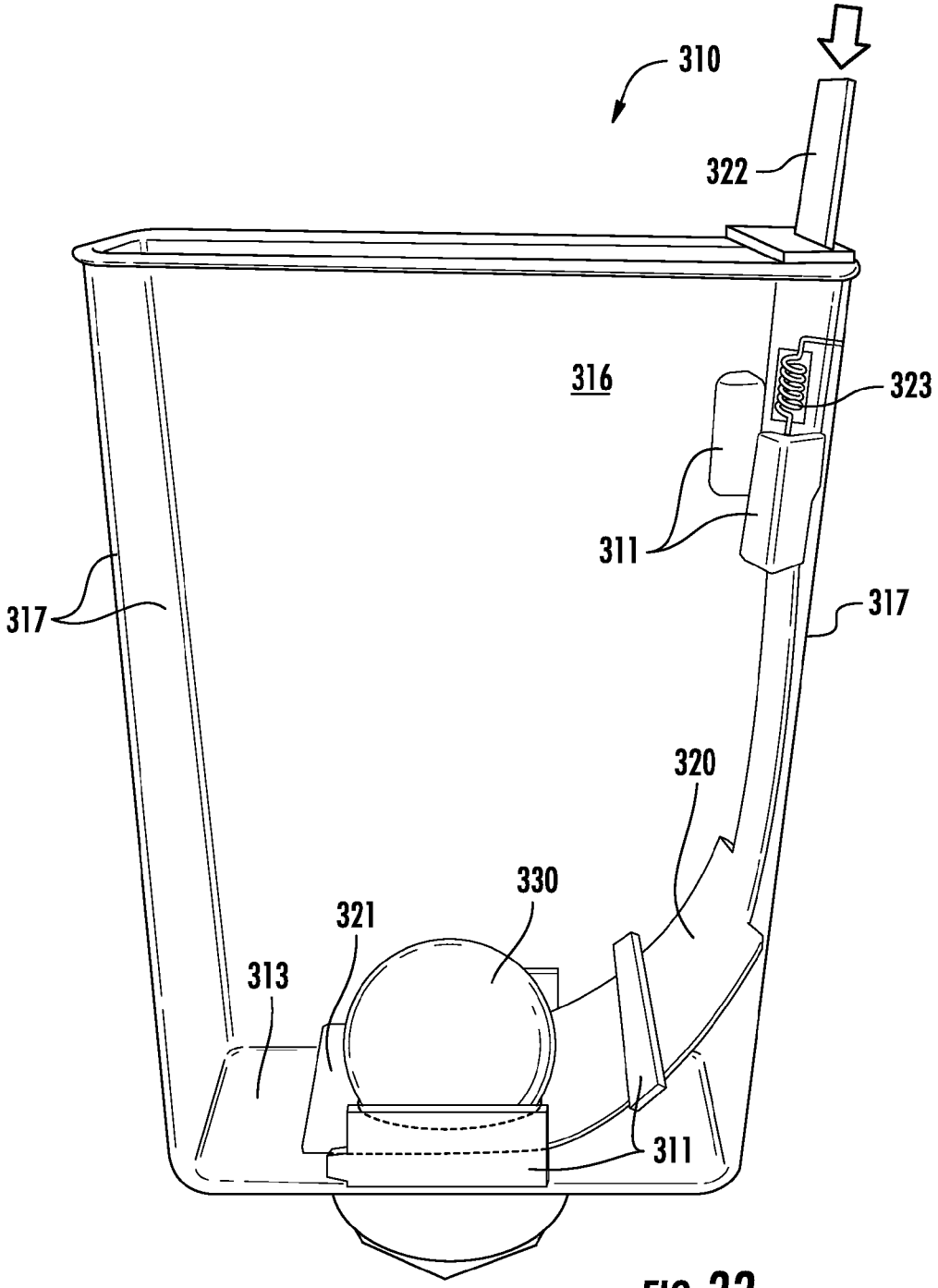
FIG. 33 is a front perspective view of a water tank system according to another exemplary embodiment.
Figure 34:
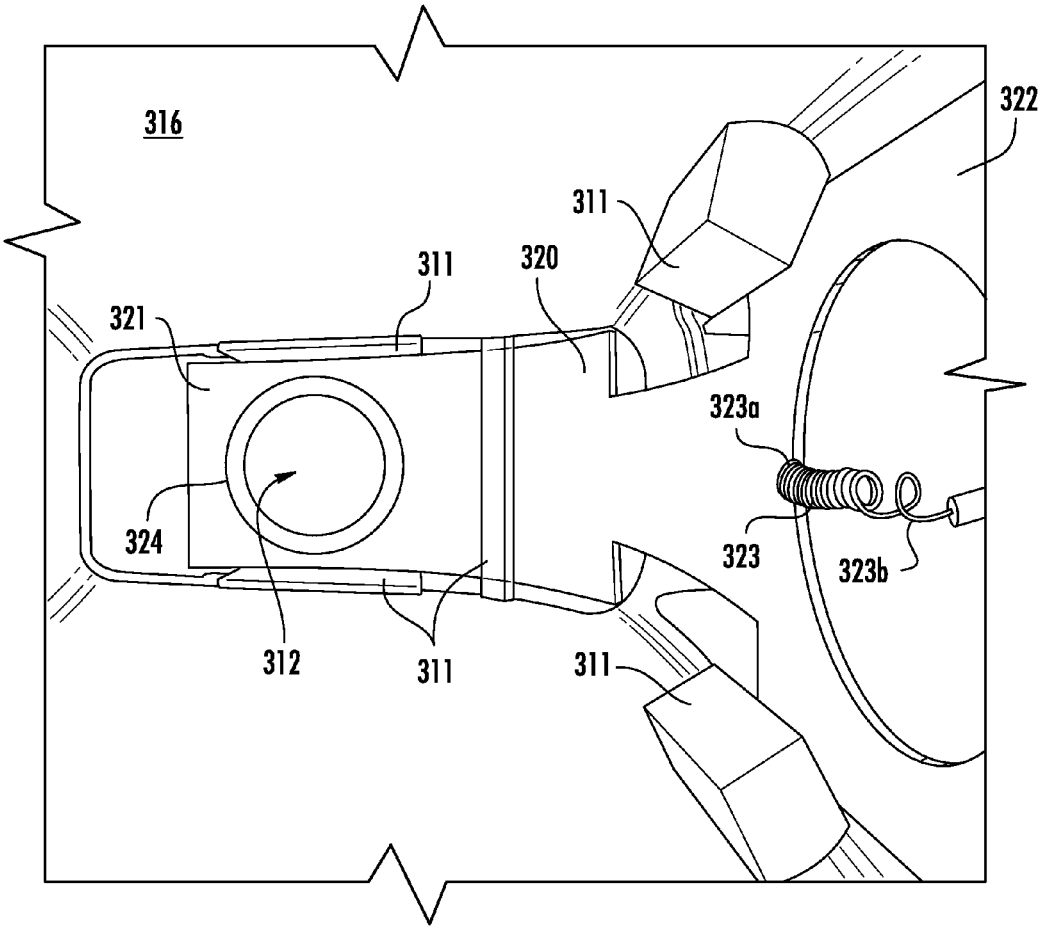
FIG. 34 is a top view of the water tank system of FIG. 33 without a free-floating flush ball according to an exemplary embodiment.

According to an exemplary embodiment shown in FIGS. 33-34, the slide member 320 further includes a return element, such as a spring 323. The spring 323 is configured to return the slide member 320 to its original position after the slide member 320 is actuated (i.e., after a user initiates a flush function). As shown in FIG. 34, the spring 323 includes a first spring end 323*a* and a second spring end 323*b* located opposite the first spring end 323*a*. The first spring end 323*a* is coupled to a portion of the slide member 320 and the second spring end 323*b* is coupled to a portion of the water tank 310.

Figure 35:
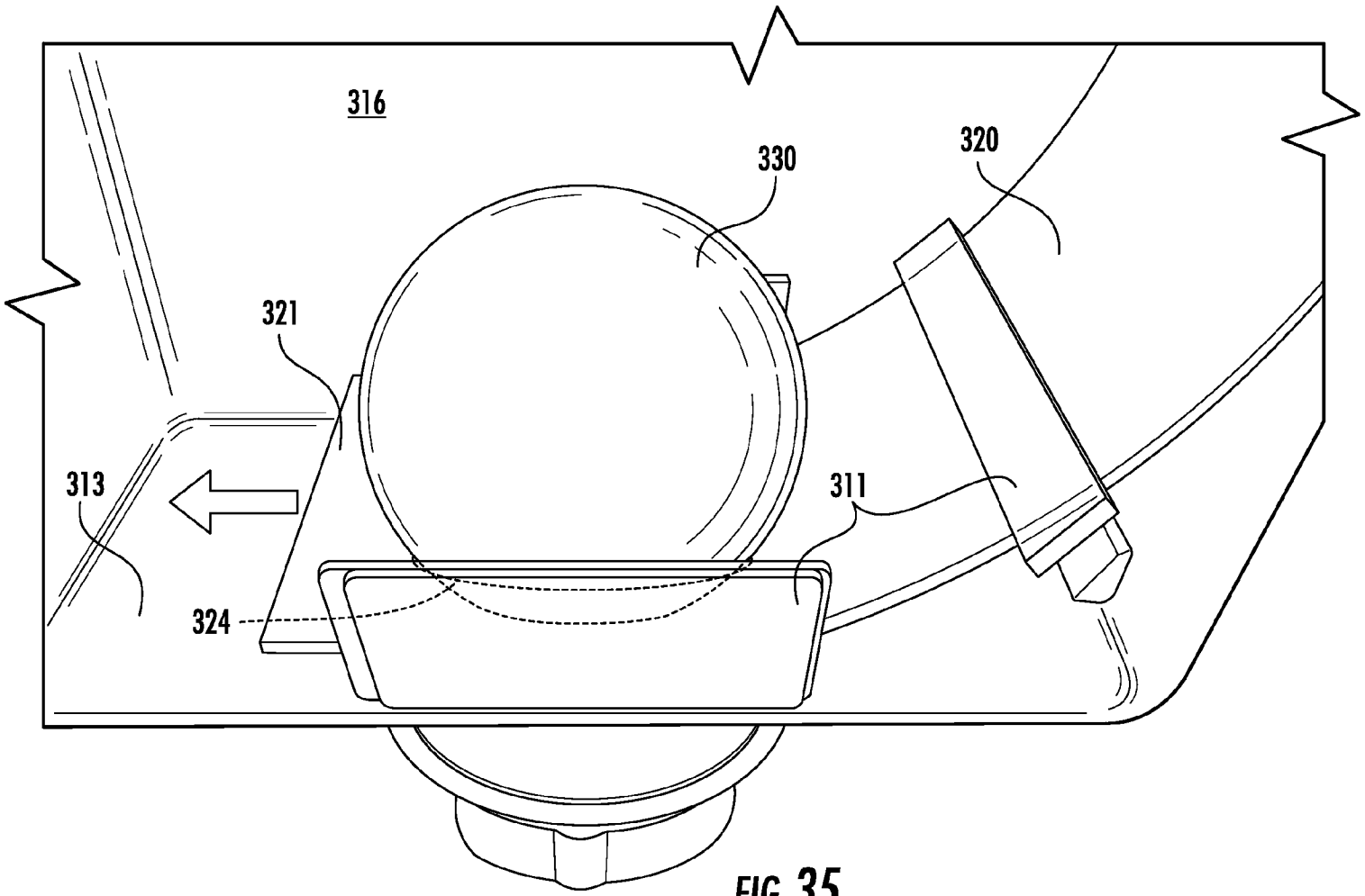
FIG. 35 is a front view of the water tank system of FIG. 33 in a first stage of a flush function according to an exemplary embodiment.

By way of example shown in FIGS. 33 and 35, the water tank 310 is shown in a first stage before a flush cycle is initiated. The flush ball 330 is seated (e.g., engaged) on the orifice 312 to block the flow of water from the water tank 310 to the orifice 312. In the first stage, a pressure from a volume of water above the flush ball 330 is greater than a pressure (e.g., air pressure) below the orifice 312 such that the flush ball 330 remains seated on the orifice 312. The opening 324 is substantially coaxial with the orifice 312. According to other exemplary embodiments, the water tank 310 may include a gasket (not shown) that engages a portion of the flush ball 330 to provide a water-tight seal between the flush ball 330 and the orifice 312.

Figure 36:
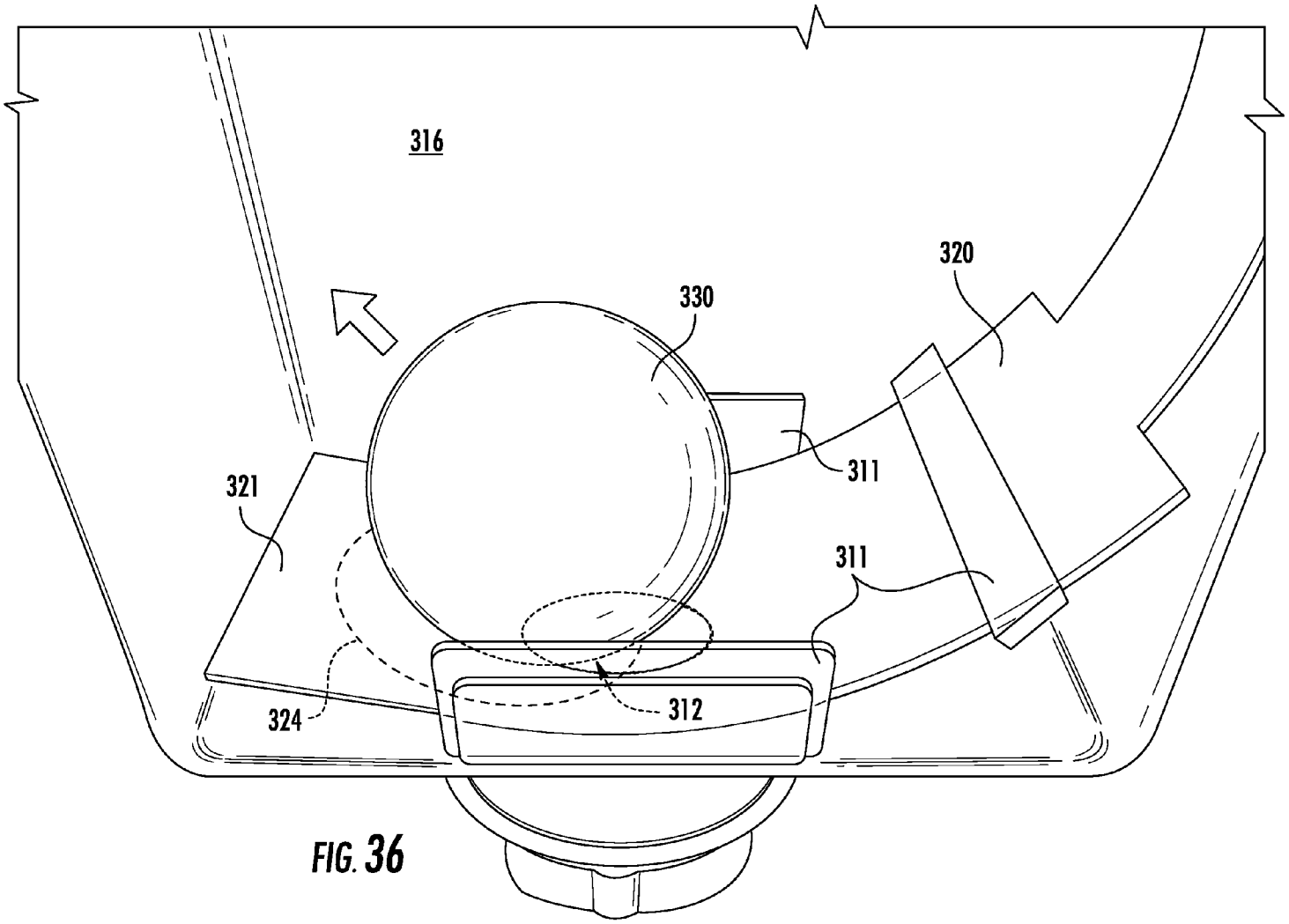
FIG. 36 is a front perspective view of the water tank system of FIG. 33 in a second stage of a flush function according to an exemplary embodiment.

Referring now to FIG. 36, the water tank 310 is shown in a second stage just after a flush cycle is initiated. After a user actuates the slide member 320 by applying a downward force (represented by the arrow shown in FIG. 33) to the slide member 320, the first end 321 moves (e.g., translates, slides, etc.) a distance relative to the bottom surface 313 such that the opening 324 is offset from the orifice 312. When the slide member 320 is actuated, a portion of the slide member 320 contacts (e.g., engages, touches, etc.) the flush ball 330, causing the flush ball 330 to disengage (e.g., unseat, displace, etc.) from the orifice 312. Once the flush ball 330 is disengaged from the orifice 312, the opening 324 is no longer coaxial with the orifice 312 and at least a portion of the slide member 320 restricts (e.g., overlaps, covers, etc.) at least a portion of the orifice 312. Because the flush ball 330 is unseated and the orifice 312 is restricted, water pressure below the flush ball 330 increases. The increase in water pressure below the flush ball 330 causes the buoyancy of the flush ball 330 to carry it upward into the flush chamber 316 away from the slide member 320 and the orifice 312.

The slide member 320 can return to its original position (e.g., the first stage), by way of the spring 323 such that the opening 324 is once again coaxial with the orifice 312. Water within the tank 310 can flow unrestricted (e.g., unimpeded, uninterrupted, etc.) from the flush chamber 316 through the opening 324 to the orifice 312 while the flush ball 330 is unseated. As water exits the flush chamber 316, the flush ball 330 can follow the flow of water to the orifice 312 and automatically re-seat itself on the orifice 312 with the opening 324 positioned therebetween.

Figure 37:
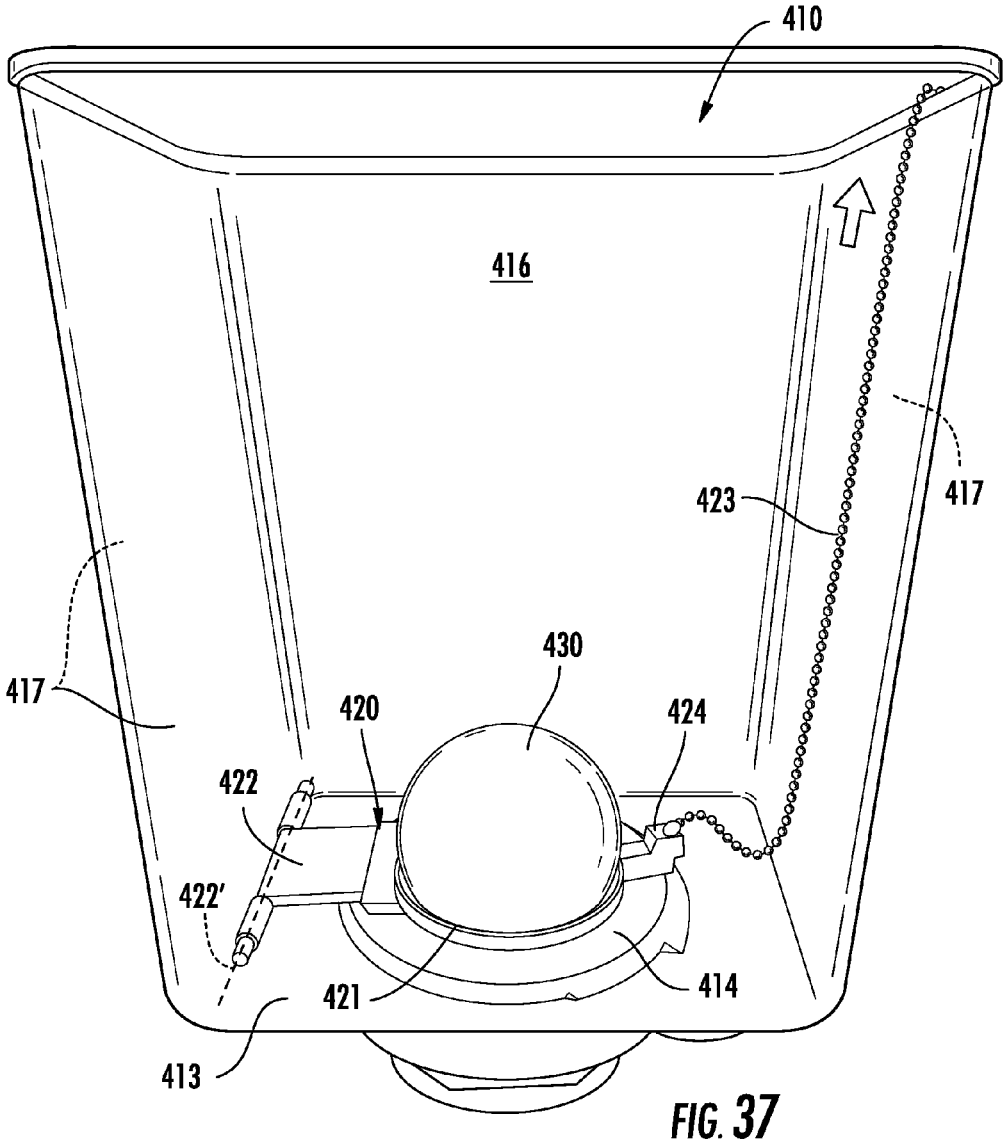
FIG. 37 is a front perspective view of a water tank system in a first stage of a flush function according to another exemplary embodiment.
Figure 38:
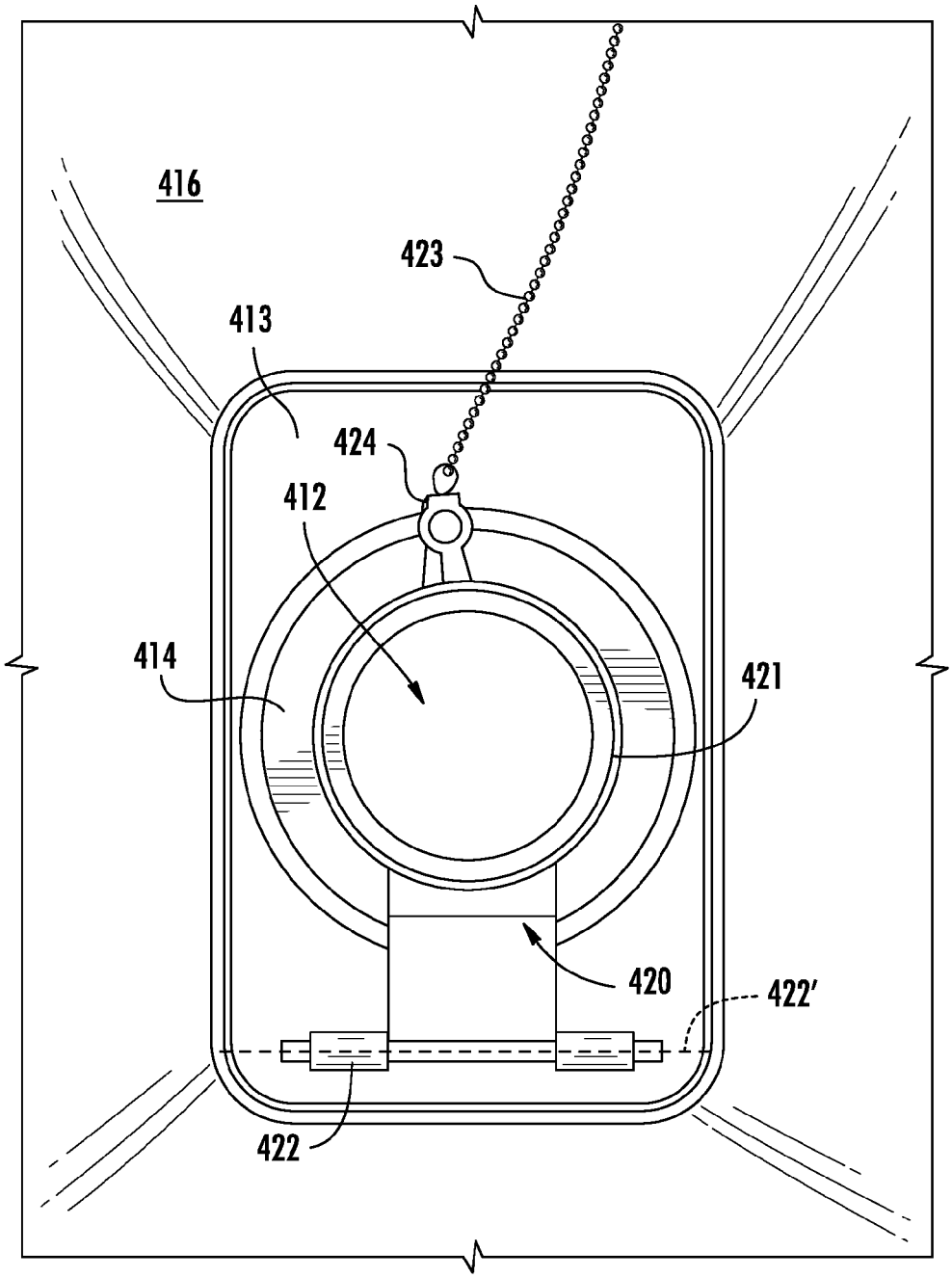
FIG. 38 is a top view of the water tank system of FIG. 37 without a free-floating flush ball according to an exemplary embodiment.
Figure 39:
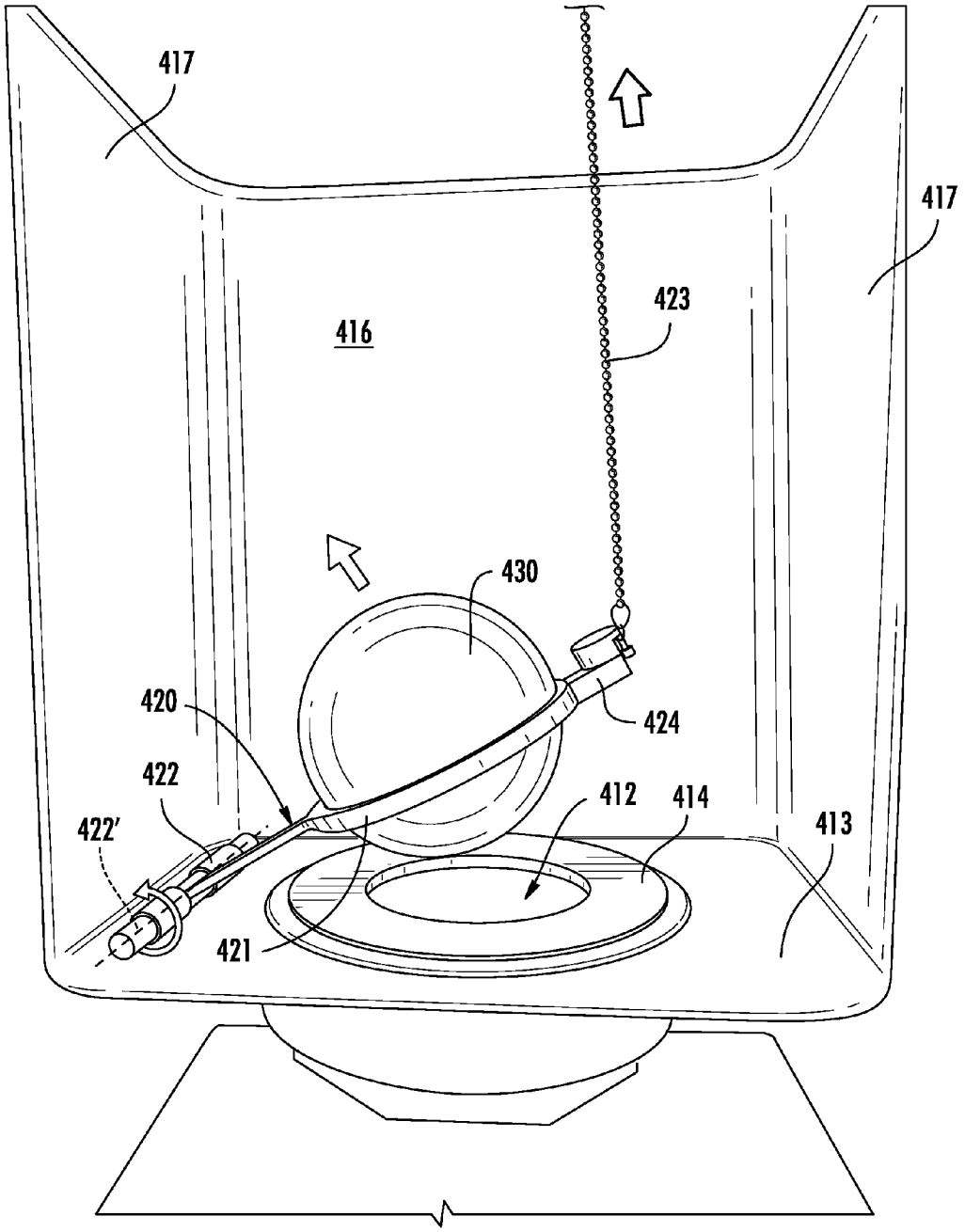
FIG. 39 is a front perspective view of the water tank system of FIG. 37 in a second stage of a flush function according to an exemplary embodiment.

Referring now to FIGS. 37-39, a water tank 410 similar to the water tank 310 described above is shown according to another exemplary embodiment. As shown in FIGS. 37-39, the water tank 410 includes a free-floating (e.g., buoyant) member in the form of a flush ball 430 forming a fluid seal over an orifice 412. The orifice 412 may be configured to provide a fluid connection between the water tank 410 and a toilet bowl (not shown) when the flush ball 430 is disengaged (e.g., unseated) from the orifice 412 to break the fluid seal. In this embodiment, a flush ball actuator in the form of a pivot member 420 is shown coupled to the water tank 410 and disposed between a portion of the water tank 410 and the flush ball 430. The pivot member 420 is configured to be manually or automatically actuated by a user to lift (e.g., raise, engage, etc.) and disengage (e.g., unseat, displace, etc.) the flush ball 430 from the orifice 412, to thereby allow water to exit the tank 410 unrestricted (e.g., unimpeded, uninterrupted, etc.) by the flush ball 430 during a flush cycle. The flush ball 430 is configured to automatically re-seat itself over the orifice 412 by following the flow of water flowing out of the water tank 410 during the flush cycle without being connected/coupled to a chain, tether, or any other types of guides. In this manner, the water tank 410 achieves effective and reliable flushing without the use of traditional flapper valves, which can wear prematurely after repeated use and can restrict/impede water flow to the orifice. Furthermore, the water tank 410 does not require the use of guides or other similar elements for directing the flush ball 430 to a seated position over the orifice 412.

As shown in FIGS. 37-39, the pivot member 420 is pivotally coupled to the water tank 410 via a hinge 422 at a fixed end. The hinge 422 is shown coupled to a bottom surface 413 of the tank 410. According to other exemplary embodiments (not shown), the hinge 422 is coupled to a different portion of the tank, such as one or more sidewalls 417. The pivot member 420 also includes a ring 421 (e.g., hollow cylinder, hoop, etc.) extending from the fixed end. The ring 421 has an inner diameter that is less than a diameter of the flush ball 430. The inner diameter is larger than a diameter of the orifice 412 to allow the flush ball 430 to engage (e.g., seat, contact, etc.) the orifice 412 when the ring 421 is disposed between the flush ball 430 and the orifice 412. The ring 421 is further configured to surround the orifice 412 and to allow fluid to exit the flush chamber 416 when the flush ball 430 is unseated (e.g., disengaged) from the orifice 412. The pivot member 420 also includes a free end 424 that extends from the ring 421 opposite the fixed end. The free end 424 is coupled to a link member, such as a chain 423. The chain 423 couples the pivot member 420 to a trip lever (not shown) or other suitable actuator for actuating (e.g., pivoting, moving, etc.) the pivot member 420 to initiate a flush function.

According to an exemplary embodiment, the pivot member 420 may be made out of various rigid materials or combinations of materials such as plastic, composite, treated metal, or other suitable materials. According to other exemplary embodiments, the link member may be any type of linking element suitable for coupling the pivot member to an actuator to allow a user to initiate a flush function.

According to various exemplary embodiments, different actuation methods such as those shown in FIG. 32 and as previously described may be used in conjunction with the pivot member 420 to enable a user to manually and/or automatically perform a flush function. For example, the pivot member 420 may be actuated by applying an upward force to the free end 424 (represented by the arrow in FIG. 39 near an upper portion of the chain 423) using one or more of the actuation methods previously described with reference to FIG. 32. The upward force is such that the pivot member 420 pivots (e.g., rotates) about the axis 422' relative to the orifice 412 a sufficient distance to lift (e.g., raise) the flush ball 430 from the orifice 412, thereby disengaging (e.g., unseating) the flush ball 430 from the orifice 412.

By way of example shown in FIG. 37, the water tank 410 is shown in a first stage before a flush cycle is initiated. The flush ball 430 is shown seated on a gasket 414 coupled to the orifice 412 to block the flow of water from the tank 410 to the orifice 412. In the first stage, the pressure from a volume of water above the flush ball 430 is greater than a pressure (e.g., air pressure) below the flush ball within the orifice 412, such that the flush ball 430 remains seated over the orifice 412.

Referring now to FIG. 39, the toilet water tank 410 is shown in a second stage just after a flush cycle is initiated. After a user actuates the pivot member 420 by applying an upward force to the free end 424, the pivot member 420 pivots about the axis 422' in a generally upward direction relative to the bottom surface 413. When the pivot member 420 is actuated, at least a portion of the pivot member 420 contacts (e.g., engages, touches, etc.) and lifts (e.g., raises) the flush ball 430 away from the orifice 412, causing the flush ball 430 to unseat (e.g., disengage, displace, etc.) from the gasket 414. Because the flush ball 430 is unseated, water pressure below the flush ball 430 increases. The increase in water pressure below the flush ball 430 causes the buoyancy of the flush ball 430 to carry it upward (represented by the arrow in FIG. 39) into the flush chamber 416 away from the orifice 412. The pivot member 420 pivots back to the original position (i.e., the first stage) by way of gravity. According to other exemplary embodiments, the pivot member includes a spring (not shown) coupled to the hinge 422 to return the pivot member 420 to the original position after being actuated. After the pivot member returns to the first stage and while the flush ball 430 is unseated, water within the tank 410 can flow from the flush chamber 416 through the ring 421 to the orifice 412 unrestricted (e.g., unimpeded, uninterrupted, etc.) by the flush ball 430. As water exits the flush chamber 416 through the orifice 412, the flush ball 430 can follow the flow of water toward the orifice 412 and automatically re-seat itself on the gasket 414 with the ring 421 positioned therebetween.

According to various exemplary embodiments, each of the water tanks 310 and 410 described above may be used in conjunction with another component that conceals, covers, or shrouds each water tank (e.g., a cover or a shroud), as illustrated in the embodiments previously described with reference to FIGS. 23-26. According to other exemplary embodiments, each of the water tanks 310 and 410 may include a cage coupled to the flush chamber above the orifice for guiding the flush ball during a flush cycle, as previously described with reference to FIGS. 15 and 21-22. According to other exemplary embodiments, each of the water tanks 310 and 410 may further include a base for coupling (e.g., connecting, mounting, etc.) each water tank to a toilet bowl, as previously described with reference to FIG. 4.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A water tank for a toilet, the water tank comprising:

a first chamber comprising an orifice for connecting to a toilet bowl; and a free-floating member within the first chamber that is not coupled to any other component and that is configured to selectively engage with and disengage from the orifice to selectively block or allow a flow of water through the orifice;

wherein the free-floating member is configured to be selectively disengaged from the orifice in response to a differential pressure created within the water tank by releasing a volume of air from within the water tank to the outside atmosphere free from any mechanical actuator engaging with, or disengaging from, the free-floating member.

2. The water tank of claim 1, wherein the first chamber further comprises a first check valve for fluidly connecting the first chamber to the outside atmosphere.

3. The water tank of claim 2, further comprising a second chamber fluidly connected to the first chamber and a second check valve for fluidly connecting the second chamber to the outside atmosphere.

4. The water tank of claim 3, wherein the differential pressure within the water tank is created upon actuation of at least one of the first and second check valves to selectively release the volume of air from the water tank.

5. The water tank of claim 4, further comprising a third chamber having an upper portion fluidly connected to the first chamber and to the outside atmosphere, and a bottom portion fluidly connected to the orifice;

wherein the upper portion is configured to receive an amount of water from the first chamber that exceeds a predetermined height within the first chamber, and the bottom portion is configured to direct the amount of water to the orifice.

6. The water tank of claim 1, wherein the free-floating member is a ball having a buoyancy such that the ball freely floats within the water tank when the ball is disengaged from the orifice.

7. A water tank for a toilet, the water tank comprising:

a first chamber comprising an orifice for fluidly connecting the first chamber to a toilet bowl and further comprising a first check valve for fluidly connecting the first chamber to the outside atmosphere;

a second chamber fluidly connected to the first chamber and further comprising a second check valve for fluidly connecting the second chamber to the outside atmosphere;

a free-floating member in the first chamber selectively engaged with the orifice and configured to block a flow of water through the orifice; and wherein the first and second check valves are each configured to selectively release a volume of air from the water tank to the outside atmosphere, creating a differential pressure within the water tank such that the free-floating member is selectively disengaged from the orifice free from any mechanical actuator engaging with, or disengaging from, the free-floating member, allowing water to exit the water tank through the orifice.

8. The water tank of claim 7, wherein the orifice is located below the first chamber, and the first chamber has a funnel shape for directing water contained within the water tank toward the orifice.

9. The water tank of claim 8, wherein the second chamber is configured to maintain a positive pressure in an air space above a volume of water contained within the second chamber when the second check valve is in a closed position before initiating a flush cycle.

10. The water tank of claim 9, wherein the second chamber is further configured to receive at least a portion of water contained within the first chamber when air is released from the air space within the second chamber via opening of the second check valve, creating a negative pressure within an air space of the first chamber.

11. The water tank of claim 10, wherein the free-floating member is a ball having a buoyancy such that the ball selectively disengages from the orifice in response to the negative pressure.

12. The water tank of claim 11, further comprising a vent fluidly connected to the first chamber and the outside atmosphere, wherein the vent is configured to fill with water to a height approximately equal to a water level of the water contained within the first chamber, and to resist air entry from the outside atmosphere.

13. The water tank of claim 12, further comprising a third chamber having an upper portion fluidly connected to the first chamber and to the outside atmosphere, and a bottom portion fluidly connected to the orifice;

wherein the upper portion is configured to receive an amount of water from the first chamber that exceeds a predetermined height within the first chamber, and the bottom portion is configured to direct the amount of water to the orifice.

* * * * *